US006437751B1

(12) United States Patent
Craven et al.

(10) Patent No.: US 6,437,751 B1
(45) Date of Patent: Aug. 20, 2002

(54) CONTRAWOUND ANTENNA

(75) Inventors: Robert P. M. Craven, Morgantown; James E. Smith, Bruceton Mills, both of WV (US); Larry Hawks, Kokomo, IN (US); Roy S. Nutter, Jr.; Franz A. Pertl, both of Morgantown, WV (US)

(73) Assignee: West Virginia University, Morgantown, WV (US)

( * ) Notice: Subject to any disclaimer, the term of this patent is extended or adjusted under 35 U.S.C. 154(b) by 0 days.

(21) Appl. No.: 09/639,361

(22) Filed: Aug. 15, 2000

(51) Int. Cl.[7] ..... H01Q 11/12
(52) U.S. Cl. ..... 343/742; 343/867; 343/870
(58) Field of Search ..... 343/742, 741, 343/744, 743, 866, 867, 895, 788, 748, 870; H01Q 11/12

(56) References Cited

U.S. PATENT DOCUMENTS

| | | | | |
|---|---|---|---|---|
| 3,284,801 | A | 11/1966 | Bryant | |
| 3,646,562 | A | 2/1972 | Acker et al. | |
| 3,671,970 | A | 6/1972 | Layton | |
| 3,721,989 | A | 3/1973 | Christensen | |
| 4,622,558 | A | 11/1986 | Corum | |
| 4,751,515 | A | 6/1988 | Corum | |
| 4,999,642 | A | 3/1991 | Wells | |
| 5,159,332 | A | 10/1992 | Walton | |
| 5,257,033 | A | 10/1993 | Roche | |
| 5,442,369 | A | 8/1995 | Van Voorhies et al. | |
| 5,654,723 | A | 8/1997 | Craven et al. | |
| 5,734,353 | A | 3/1998 | Van Voorhies | |
| 5,952,978 | A | 9/1999 | Van Voorhies | |
| 6,028,558 | A | 2/2000 | Van Voorhies | |
| 6,204,821 | B1 * | 3/2001 | Van Voorhies | 343/742 |
| 6,218,998 | B1 * | 4/2001 | Van Voorhies | 343/742 |
| 6,320,550 | B1 | 11/2001 | Van Voorhies | |

FOREIGN PATENT DOCUMENTS

| | | |
|---|---|---|
| DE | 3823972 A1 | 1/1990 |
| EP | 043591 A1 | 1/1982 |
| JP | 7146386 | 6/1995 |

OTHER PUBLICATIONS

J.M. Ham, et al., "Time–Varying Electric and Magnetic Fields," Scientific Basis of Electrical Engineering, pp. 302–305, 1961.

(List continued on next page.)

*Primary Examiner*—Hoanganh Le
(74) *Attorney, Agent, or Firm*—Kirk D. Houser; Eckert Seamans Cherin & Mellott, LLC

(57) ABSTRACT

An electromagnetic antenna includes a multiply connected surface, such as a toroidal surface; first and second insulated conductors; and first and second signal terminals. The first insulated conductor extends around and over the surface with a first pitch or winding sense from a first node to a second node. The second insulated conductor also extends around and over the surface with a second pitch or winding sense, which is opposite from the first pitch or winding sense, from a third node to a fourth node. The first and second insulated conductors are contrawound relative to each other around and over the surface. In one embodiment of the invention, at least one of the nodes is open. In other embodiments of the invention, the signal terminals are structured for connection to a cooperative antenna structure.

60 Claims, 35 Drawing Sheets

(5 of 35 Drawing Sheet(s) Filed in Color)

OTHER PUBLICATIONS

Howard W. Sams, Reference Data for Radio Engineers, 7th Ed. E.C. Jordan Ed., pp. 6–13–6–14.

Kandoian, A.G., et al., "Wide Frequency–Range Tuned Helical Antennas and and Circuits," Fed. Telecommunication Laboratories, Inc., pp. 42–47, 1953.

Birdsall, C.K., et al., "Modified Contra–Wound Helix Circuits for High–Power Traveling–Wave Tubes," IRE Transactions on Electron Devices, pp. 190–206, Oct. 1956.

Harington, R.F., "Time Harmonic Electromagnetic Fields," pp. 106–111, 1961.

Van Voorhies, K.L., et al., "Energy and the Environment: A Continuing Partnership," 26th Intersociety Energy Conversion Engineering Conference, 6 pp., Aug. 1991.

Ben Smith, "CTHA Evaluation," http://www.antennex.com, pp. 1–11, Feb. 23, 2000.

* cited by examiner

FIG. 1
PRIOR ART
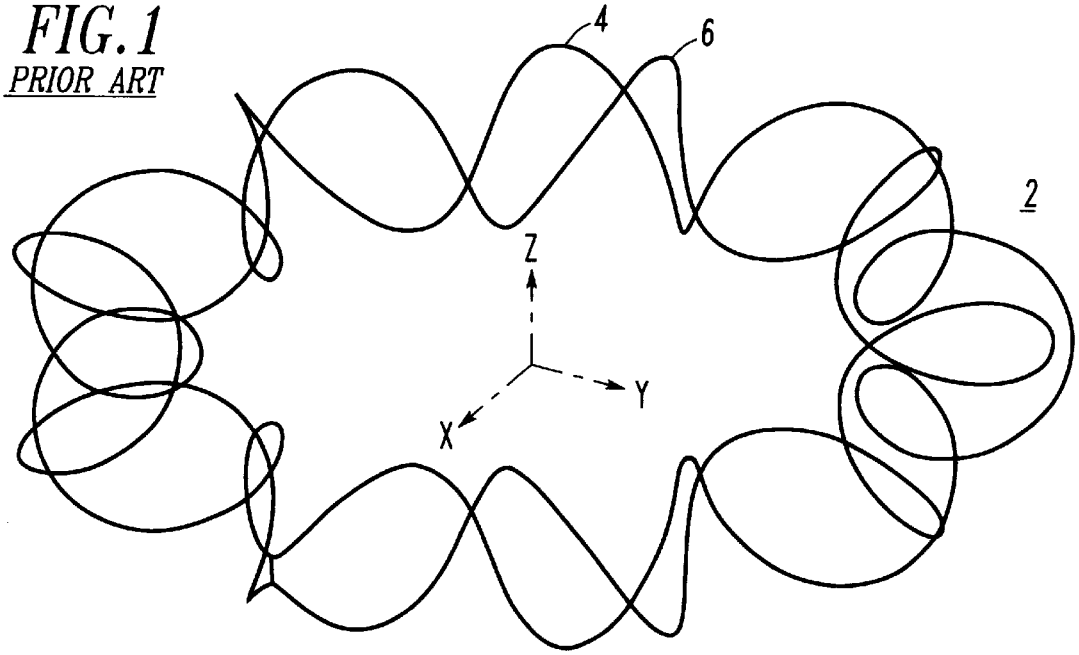
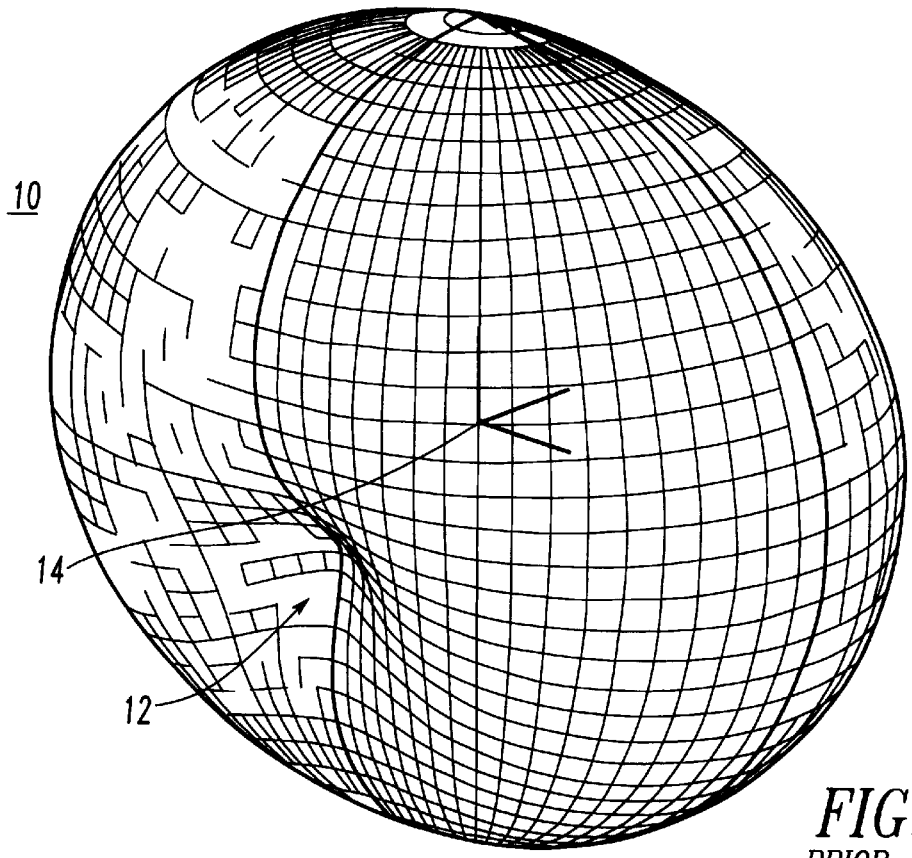
FIG. 3
PRIOR ART

THETA-POLARIZED GAIN

PHI-POLARIZED GAIN

TOTAL GAIN

THETA-POLARIZED GAIN

PHI-POLARIZED GAIN

TOTAL GAIN

THETA-POLARIZED GAIN

PHI-POLARIZED GAIN

TOTAL GAIN

THETA-POLARIZED GAIN

PHI-POLARIZED GAIN

TOTAL GAIN

THETA-POLARIZED GAIN

PHI-POLARIZED GAIN

TOTAL GAIN

THETA-POLARIZED GAIN

PHI-POLARIZED GAIN

TOTAL GAIN

THETA-POLARIZED GAIN

PHI-POLARIZED GAIN

TOTAL GAIN

FIG. 41
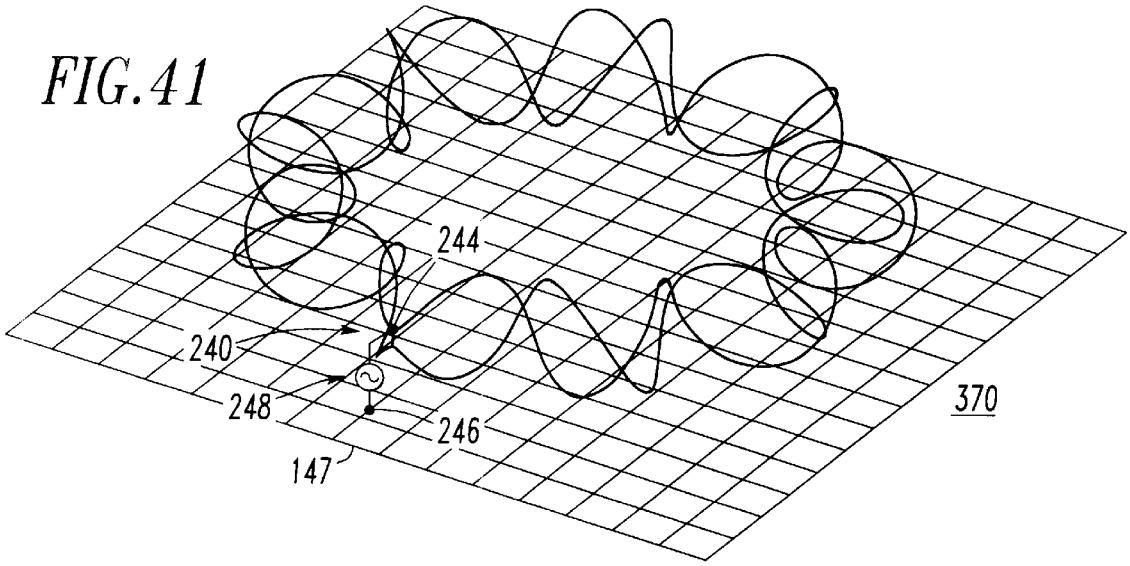
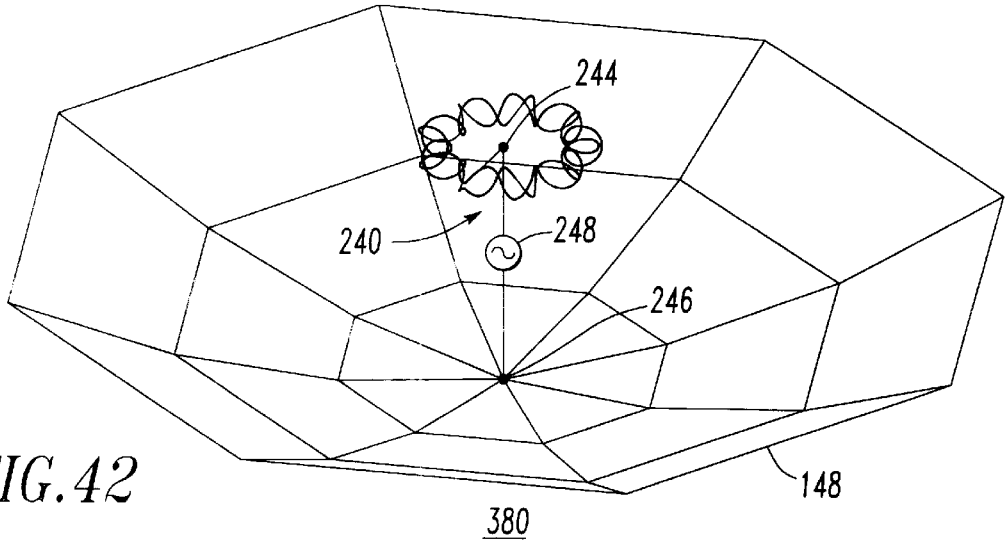
FIG. 42
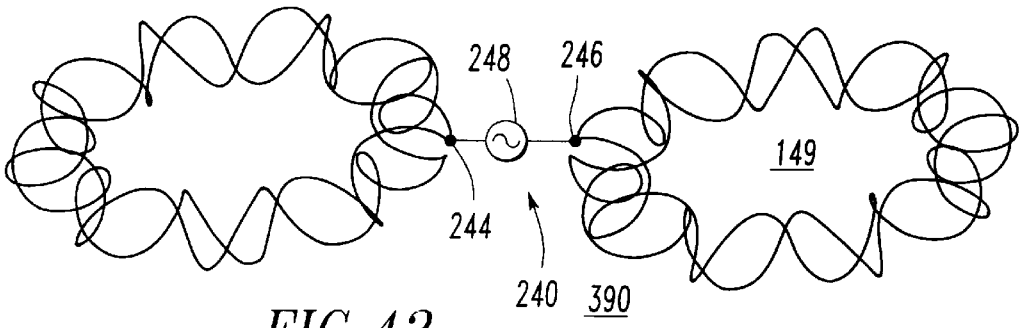
FIG. 43

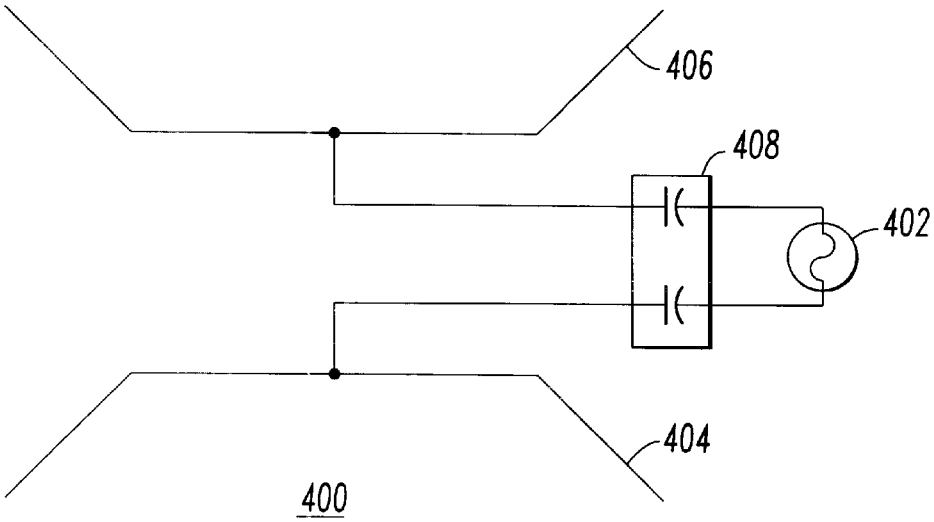
FIG. 44
FIG. 45
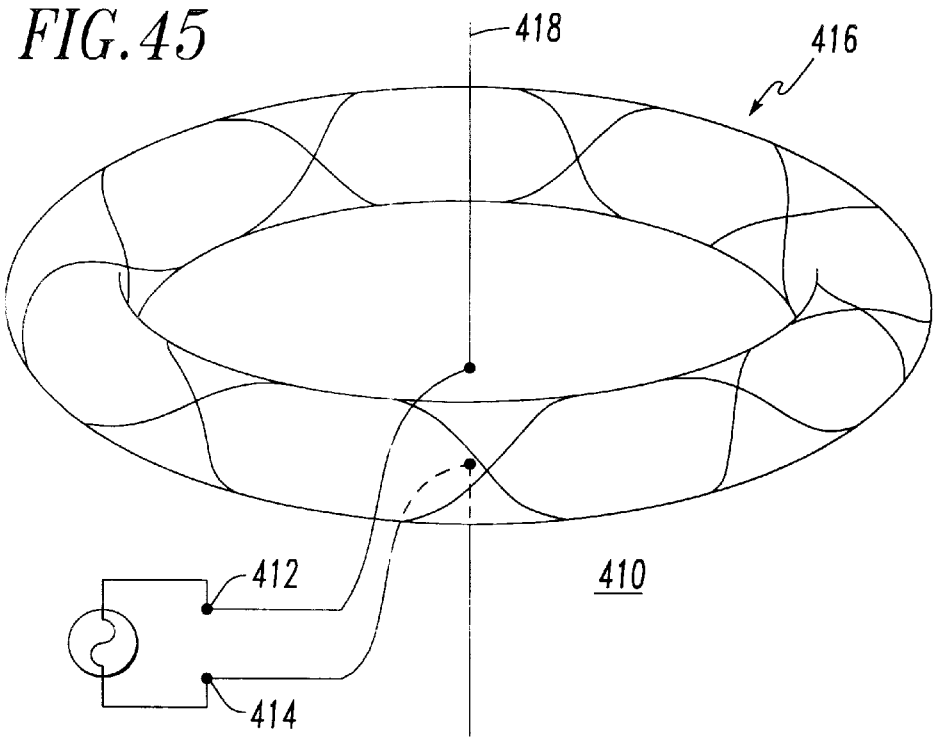

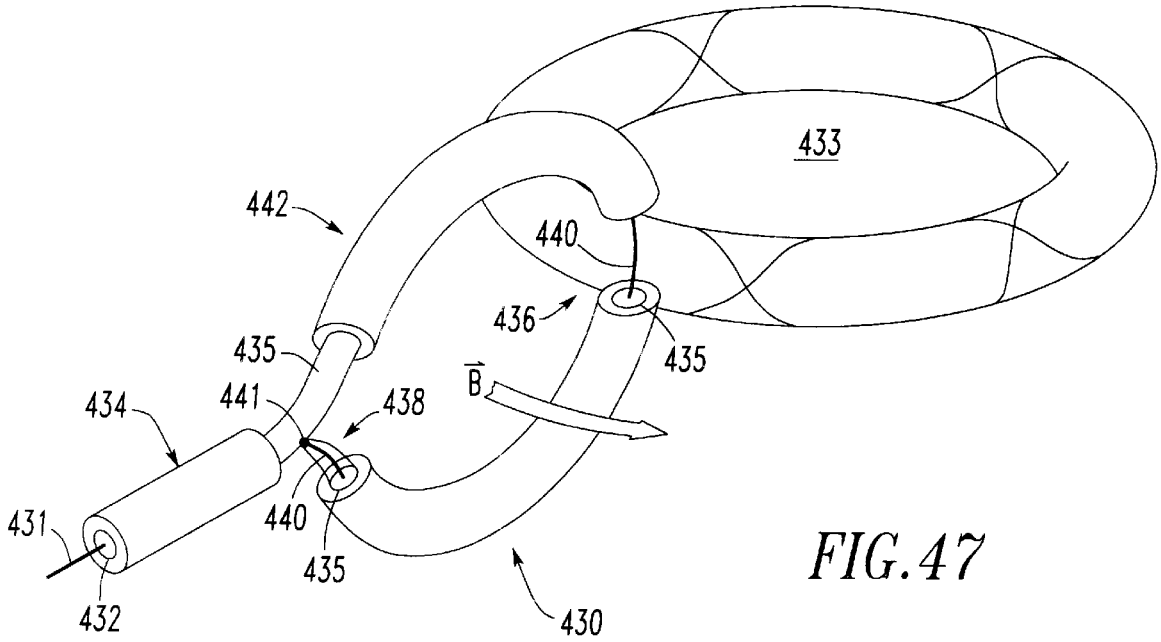
FIG. 47
FIG. 48
PRIOR ART
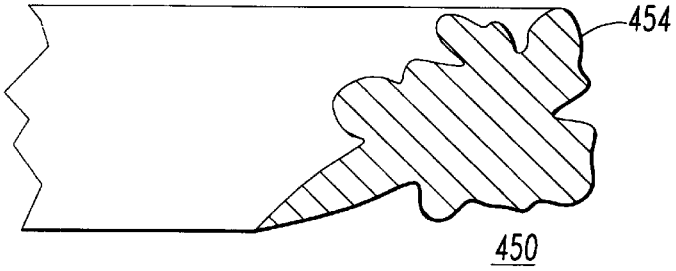
FIG. 49
PRIOR ART
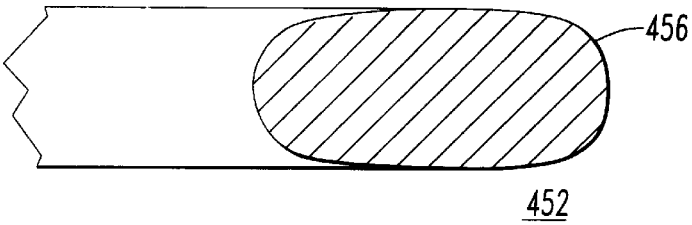

CONTRAWOUND ANTENNA

BACKGROUND OF THE INVENTION

1. Field of the Invention

This invention relates to transmitting and receiving antennas, and, in particular, to antennas employing contrawound windings.

2. Background Information

U.S. Pat. Nos. 5,442,369; and 6,028,558, which are incorporated by reference herein, disclose Contrawound Toroidal Helical Antennas (CTHAs).

Referring to FIG. 1, one type of CTHA 2, for example, employs a toroidal surface and two contrawound helical windings 4,6, which are fed with opposite currents in order that the magnetic flux of each helix reinforces the loop magnetic flux. This additive effect of the two helices may produce a stronger magnetic flux than a single toroidal helix, but the magnetic flux is not uniform. The effect can approach uniform currents for an electrically small CTHA, but suffers poor efficiency.

U.S. Pat. Nos. 4,622,558; and 4,751,515 discuss certain aspects of toroidal antennas as a technique for creating a compact antenna by replacing the conventional linear antenna with a self resonant structure that produces vertically polarized radiation that will propagate with lower losses when propagating over the earth. These patents initially discuss a monofilar toroidal helix as a building block for more complex directional antennas. Those antennas may include multiple conducting paths fed with signals whose relative phase is controlled either with external passive circuits or due to specific self resonant characteristics. In a general sense, the patents discuss the use of so called contrawound toroidal windings to provide vertical polarization. The contrawound toroidal windings discussed in these patents are of an unusual design, having only two terminals, as described in the reference Birdsall, C. K., and Everhart, T. E., "Modified Contra-Wound Helix Circuits for High-Power Traveling Wave Tubes", *IRE Transactions on Electron Devices,* October, 1956, p. 190. The patents point out the distinctions between the magnetic and electric fields/currents and extrapolate that by physically superimposing two monofilar circuits, which are contrawound with respect to one another on a toroid, a vertically polarized antenna can be created using a two port signal input. The basis for the design is the linear helix, the design equations for which were originally developed by Kandoian & Sichak in 1953.

U.S. Pat. No. 5,654,723 discloses antennas having various geometric shapes, such as a sphere. For example, if a sphere is small with respect to wavelength, then the current distribution is uniform. This provides the benefit of a spherical radiation pattern, which approaches the radiation pattern of an ideal isotropic radiator or point source, in order to project energy equally in all directions. Other geometric shapes may provide similar benefits. Contrawound windings are employed to cancel electric fields and leave a magnetic loop current. Thus, different modes of operation of a CTHA may be induced by varying the antennas' geometric properties.

U.S. Pat. No. 5,654,723 also discloses CTHA antennas employed in combination with a reflector.

U.S. Pat. Nos. 5,734,353 and 5,952,978 disclose CTHAs having feed mechanisms including series-parallel impedance matching network (FIG. 59), electric current conduction employing a magnetic loop signal coupler (FIG. 60), and magnetic induction to couple a signal, applied to terminals, from a primary coil directly to a generalized contrawound toroidal helix (FIG. 61).

It is known to employ a simple linear helix which is designed to end-fire (i.e., radiate off the end of the helix predominately) or broadside fire.

FIG. 2 shows the currents in the two helices of FIG. 1 at the half wavelength resonance as predicted by the Los Alamos National Laboratory's Numerical Electromagnetics Code (NEC). These non-uniform currents, in turn, produce non-uniform magnetic fields.

As shown in FIG. 3, the exemplary NEC simulation provides a 3D-radiation (i.e., $\theta$ plus $\phi$) pattern 10 having two dimples (only one dimple 12 is shown). This pattern about the origin 14 is considerably different from the radiation pattern of a dipole. While not all CTHA antennas have as pronounced a dimple as the one shown in FIG. 3, those antennas all share the characteristic of near isotropic radiation (i.e., there is no overhead null).

Although the prior art shows various antenna structures and feeds, there is room for improvement.

SUMMARY OF THE INVENTION

In accordance with one aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; and first and second signal terminals, wherein the first node is electrically connected to the fourth node, and the first and second signal terminals are electrically connected to the second and third nodes, respectively.

In accordance with another aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; and first and second signal terminals, wherein the third node is electrically connected to the fourth node, and the first and second signal terminals are electrically connected to the first and second nodes, respectively.

In accordance with a further aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; and first and second signal terminals, wherein the second node is electrically connected to the third node and the fourth node, and the first and second signal terminals are electrically connected to: (a) the second, third and fourth nodes, and (b) the first node, respectively.

In accordance with another aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; and first and second signal terminals, wherein the first node is electrically connected to the third node, the second node is electrically connected to the fourth node, and the first and second signal terminals are electrically connected to: (a) the first and third nodes, and (b) the second and fourth nodes, respectively.

In accordance with a further aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; and first and second signal terminals, wherein the first node is electrically connected to the second node, the third node is electrically connected to the fourth node, and the first and second.signal terminals are electrically connected to: (a) the first and second nodes, and (b) the third and fourth nodes, respectively.

In accordance with another aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; and first and second signal terminals, wherein at least one of the nodes is open.

In accordance with a further aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; and first and second signal terminals, wherein the first, third and fourth nodes are electrically connected, wherein one of the first and second signal terminals is electrically connected to the second node, and wherein the other of the first and second signal terminals is structured for connection to a cooperative antenna structure.

In accordance with another aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; first and second signal terminals; and a cooperative antenna structure, wherein one of the first and second signal terminals is electrically connected to at least one of the nodes, and wherein the other of the first and second signal terminals is electrically connected to the cooperative antenna structure.

In accordance with a further aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; first and second signal terminals structured for transmitting or receiving an antenna signal; and means for coupling the antenna signal to or from the first and second insulated conductors, wherein at least one of the nodes is open.

In accordance with another aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; first and second signal terminals structured for transmitting or receiving an antenna signal; and means for coupling the antenna signal to or from the first and second insulated conductors, wherein the first node is electrically connected to the second node, the third node is electrically connected to the fourth node, and the first and second nodes are electrically connected to the third and fourth nodes.

In accordance with a further aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; first and second signal terminals structured for transmitting or receiving an antenna signal; and means for coupling the antenna signal to or from the first and second insulated conductors, wherein the first node is electrically connected to the third node, and the second node is electrically connected to the fourth node.

In accordance with another aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; first and second signal terminals structured for transmitting or receiving an antenna signal; and a shielded loop, proximate the multiply connected surface, without passing completely around the surface, connected to the signal terminals and coupling the antenna signal to or from the first and second insulated conductors, wherein the first node is electrically connected to the fourth node, and the second node is electrically connected to the third node.

In accordance with a further aspect of the invention, an electromagnetic antenna comprises: a multiply connected surface; first and second insulated conductors, with the first insulated conductor extending around and over the multiply connected surface with a first pitch or winding sense from a first node to a second node, and with the second insulated conductor also extending around and over the multiply connected surface with a second pitch or winding sense, which is opposite from the first pitch or winding sense, from a third node to a fourth node, in order that the first and second insulated conductors are contrawound relative to each other around and over the multiply connected surface; first and second signal terminals structured for transmitting or receiving an antenna signal; and means for coupling the antenna signal to or from the first and second insulated conductors, wherein the first node is electrically connected to the second node, and the third node is electrically connected to the fourth node.

BRIEF DESCRIPTION OF THE DRAWINGS

A full understanding of the invention can be gained from the following description of the preferred embodiments when read in conjunction with the accompanying drawings in which:

FIG. 1 is an isometric view of two helical windings in a Contrawound Toroidal Helical Antenna (CTHA) structure;

FIG. 3 is a plot of the radiation pattern of the CTHA of FIG. 1 for the current distribution of FIG. 2;

FIG. 41 is a block diagram in schematic form of an electromagnetic antenna employing a ground plane;

FIG. 42 is a block diagram in schematic form of an electromagnetic antenna employing a reflector;

FIG. 43 is a block diagram in schematic form of an electromagnetic antenna employing a second contrawound toroidal helical antenna;

FIG. 44 is a block diagram in schematic form of an electromagnetic antenna in which the antenna signal is capacitively coupled to the contrawound insulated conductors;

FIG. 45 is a block diagram in schematic form of an electromagnetic antenna in which signal terminals provide antenna coupling of a passive element in an array;

FIG. 47 is a block diagram in schematic form of an electromagnetic antenna in which the antenna signal is inductively or magnetically coupled to the contrawound insulated conductors; and FIGS. 48 and 49 are cross-sectional views of alternative multiply connected surfaces.

DESCRIPTION OF THE PREFERRED EMBODIMENTS

Figure 2:
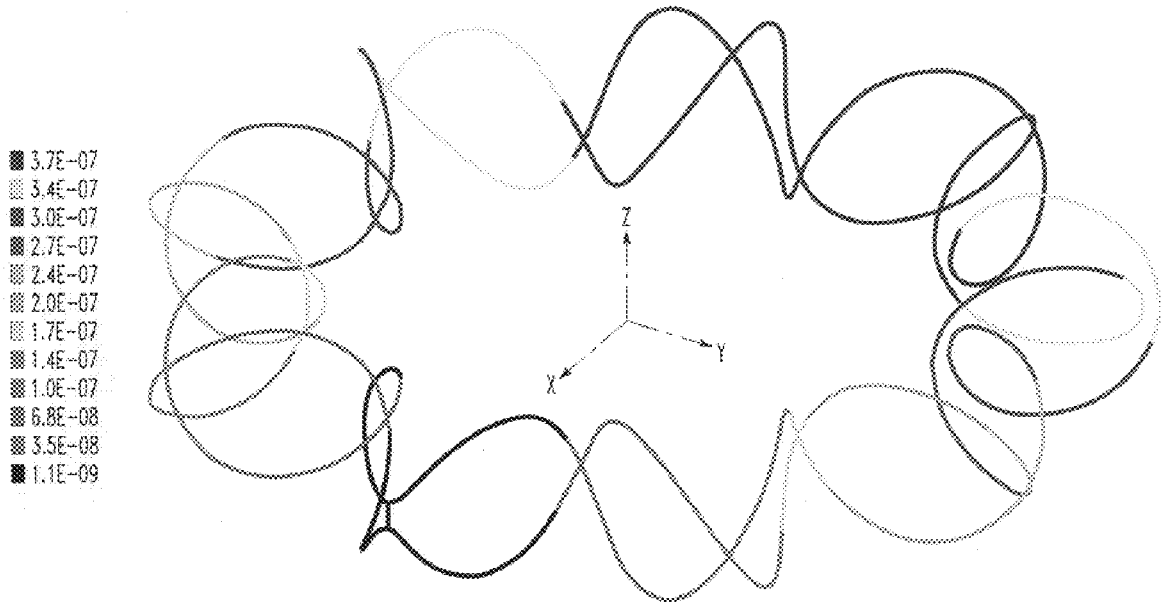
FIG. 2 is a plot, which shows the current distribution of the CTHA of FIG. 1 at a self-resonance.

As employed herein the term "multiply connected surface" shall expressly include, but not be limited to: (a) any toroidal surface, such as a preferred toroid form having its major radius greater than or equal to its minor radius, or a toroid form having its major radius less than its minor radius (see, for example, U.S. Pat. No. 5,654,723); (b) other surfaces formed by rotating and transforming a plane closed curve or polygon having a plurality of different radii about an axis lying on its plane; and (c) still other surfaces, such as surfaces like those of a washer or nut such as a hex nut, formed from a generally planar material in order to define, with respect to its plane, an inside circumference greater than zero and an outside circumference greater than zero, with the outside and inside circumferences being either a plane closed curve and/or a polygon. Furthermore, such multiply connected surfaces may include surfaces formed by an air core or formed on parallel layers of a printed circuit board antenna.

Many factors must be considered when designing an antenna: the efficiency, the input impedance, the far-field radiation pattern, the polarization of the radiated energy, and the size and shape of the antenna. Different applications may stress different factors in the design process.

In accordance with an important aspect of the present invention, the feed of the antenna gives the antenna designer an additional parameter to vary in trying to meet application-specific requirements.

The strength of the prior art CTHA lies in its relatively low profile, which yields a nearly isotropic radiation pattern of predominately theta-polarized radiation. Not all communication tasks require this combination of characteristics. Thus, new characteristics may be developed by varying antenna parameters, including the feed.

For example, an antenna application might need phi-polarized radiation, or it may be geometrically constrained into a vertical position but still need theta-polarized radiation.

As another example, even when a CTHA is in a vertical position (e.g., in a lollipop mode, in the manner of a coin standing on its edge, with the plane of the major circumference being perpendicular to the ground), it is still a compact device that is smaller than conventional antennas, such as a vertical loop antenna.

In an application where cost is the dominating factor, such as a disposable smart card, the need to obtain a 50 ohm input impedance, without the use of costly discrete components in a matching network, may cause an antenna designer to sacrifice uniform radiation pattern or antenna efficiency in the quest for a naturally matched antenna. For example, this case might occur for an in-room communication link connecting a portable device to a network via a wireless link.

A significant variety may be introduced both to input impedance characteristics and to the polarization and radiation pattern of an antenna through the feed selections disclosed herein.

An alternative method of feeding a CTHA includes the use of inductive loops. While the present invention concentrates on various physical connections, other techniques may be applied alone or in combination with any of the physical connections to create a rapid expansion of the number of possible feeds.

The CTHA may have multiple sections, each with a potentially different feed, as in the four sections of the Quad-Contra configuration disclosed in U.S. Pat. No. 5,442,369. For simplicity of disclosure, the following disclosure is with regard to a single contrawound toroidal section, although a plurality of sections may be employed to increase the possible feed configurations.

A single section CTHA has four wire ends, each of which may be: (1) left alone; (2) electrically connected to another wire end; and/or (3) electrically connected to one of two transmitter and/or receiver feed lines. Conversely, each of those two feed lines from the transmitter and/or receiver may be: (1) electrically connected to a wire end; (2) electrically connected to a group of wire ends; (3) electrically connected to something completely different (e.g., a ground plane, reflector, inductively coupled loop); or (4) left unconnected.

Figure 4A:
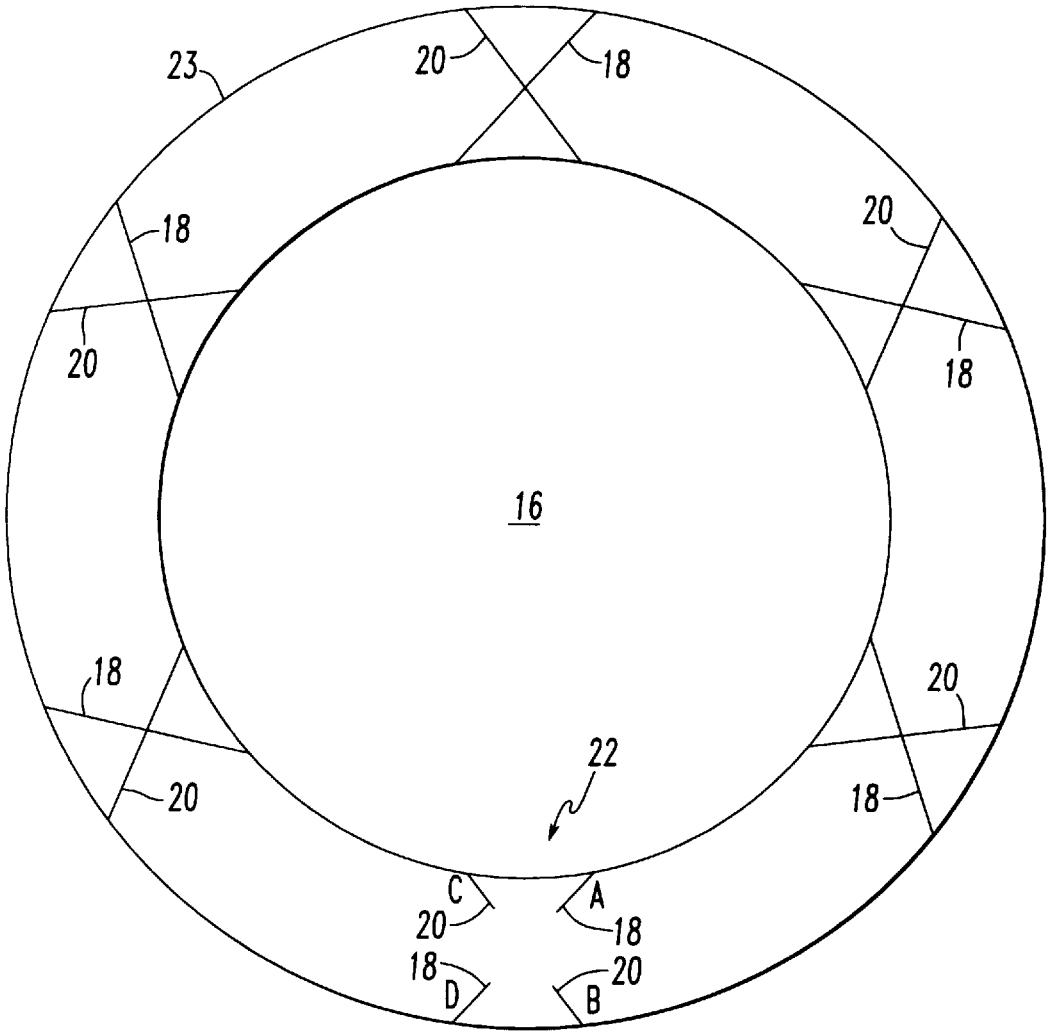
FIG. 4A PRIOR ART
FIGS. 4A–4B are wiring diagrams for CTHAs having polar and equatorial crossings, respectively.
Figure 4B:
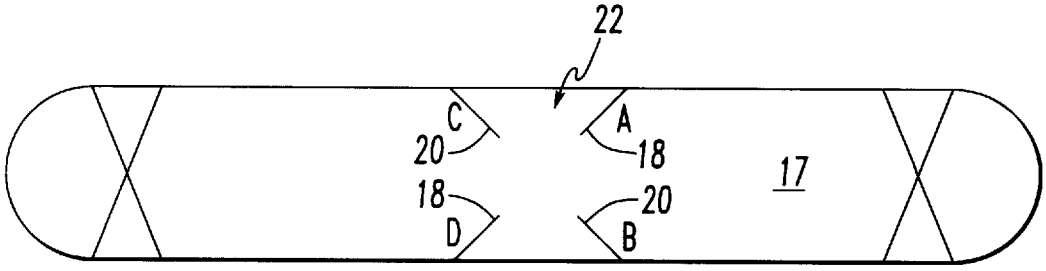
FIG. 4B PRIOR ART

FIGS. 4A–4B show wire ends A,B,C,D for two different CTHA antennas 16,17. The CTHA antenna 16 of FIG. 4A has "polar" crossings at the top and the bottom (only the crossings at the top of the antenna 16 are shown) thereof, while the CTHA antenna 17 of FIG. 4B, which is shown in profile, has equatorial crossings at the outside and the inside (only the crossing at the outside of the antenna 17 are shown) thereof. In either case, two conductors 18,20 are employed with both ends in the feed area 22. The conductor 18 has ends A,D, while the conductor 20 has ends B,C.

In one embodiment of the invention, the conductors 18,20 are insulated conductors. The first insulated conductor, such as 18, extends around and over a multiply connected surface, such as the exemplary toroidal surface 23, with a first pitch or winding sense (e.g., a right-handed winding sense) from the node A to the node D. The second insulated conductor, such as 20, extends around and over the exemplary surface 23, with a second pitch or winding sense (e.g., a left-handed winding sense) from the node B to the node C. The first and second pitch or winding senses are opposite, in order that the conductors 18,20 are contrawound relative to each other around and over the surface 23.

As disclosed, for example, in U.S. Pat. No. 6,028,558, and as shown in FIG. 5F, ends or nodes A and C are suitably electrically connected together with one electrical connection 24, and ends or nodes B and D are suitably electrically connected together with another electrical connection 26. This configuration imparts contra-currents on the two contrawound helices formed by the conductors 18,20. Those currents, in turn, add together to form a pseudo-poloidal current, thereby reinforcing the loop magnetic flux. This arrangement is advantageous for producing vertically polarized energy from a predominately horizontal structure. In turn, those electrical connections 24,26 form respective "signal terminals", which are structured for transmitting or receiving an antenna signal 28. Another prior CTHA feed arrangement is shown in FIG. 5E, in which the nodes D and C are electrically connected, and the nodes A and B are electrically connected to signal terminals for transmitting or receiving an antenna signal.

While "terminals" are not an essential part of CTHA antennas, terminals are employed herein as a mechanism for logically describing connections. In this regard, four terminals are employed: terminals #1 and #2 represent two feed lines, and terminals #3 and #4 represent a mechanism for connecting multiple wire ends, which are not fed. In defining the various feed arrangements which are disclosed herein, each of the four wire ends A,B,C,D can, therefore, have five possible values: the value "0" means no connection, while the values "1," "2," "3," and "4" indicate a terminal connection.

The following six rules (R1–R6) are employed in defining connections herein: (R1) if terminal #3 or #4 has a wire electrically connected to it, then it either has more than one wire electrically connected to it, or it is redundant to a configuration having no connection; (R2) terminals #3 and #4 are interchangeable (i.e., there is no logical difference); (R3) terminals #1 and #2 are interchangeable (i.e., there is no logical difference); (R4) wire ends A and B may be swapped for ends C and D, respectively (ie., there is A⇆C and B⇆D symmetry); (R5) wire ends A and D may be swapped for ends B and C, respectively (i.e., there is A⇆B and C⇆D symmetry); and (R6) wire ends A and B may be swapped for D and C, respectively (i.e., there is A⇆D and B⇆C symmetry). Rule 6 is the same as performing rule 4 followed by rule 5. These rules are employed to remove redundant and symmetrical configurations. While this procedure is not the only method for determining all possible configurations, it is sufficiently rigorous to ensure that all configurations are identified. Also, combinations of these symmetry rules are employed to remove all redundant configurations.

Table 1 shows the effect of removing redundant feed configurations by applying successive symmetry rules. There are, thus, 35 physical ways to connect a pair of feed lines to the four wire ends A,B,C,D. In turn, these may be diversified by employing multiple segment CTHAs, or by employing, for example, inductive loops, reflectors, or ground planes, in combination with the various feed configurations.

TABLE 1

| Operation | Combinations |
|---|---|
| 4 wire ends with 5 possible values | 625 |
| Rule 1 (R1) | 221 |
| Rule 2, Rule 3, and Rule 2 then Rule 3 (R2,R3,R2-R3) | 83 |
| R4, R4-R2, R4-R3, R4-R2-R3 | 51 |
| R5, R5-R2, R5-R3, R5-R2-R3 | 46 |
| R6, R6-R2, R6-R3, R6-R2-R3 | 35 |

Table 2 defines wire end terminal connections for various CTHA feeds and divides the 35 exemplary feed configurations of Table 1 into three main groups: (1) two connection feeds; (2) one connection feeds; and (3) no physical connection feeds. The third category employs alternative feed techniques (e.g., inductive loops, reflectors, ground planes, multiple antennas, antenna coupling of passive elements in an array).

TABLE 2

| | Wire | | | |
|---|---|---|---|---|
| Feed # | A | B | C | D |
| Two Connections | | | | |
| 1 | 3 | 2 | 3 | 1 |
| 2 | 1 | 0 | 0 | 1 |
| 3 | 0 | 1 | 0 | 2 |
| 4 | 2 | 1 | 0 | 0 |
| 5 | 1 | 2 | 3 | 3 |
| 6 | 2 | 1 | 2 | 1 |
| 7 | 2 | 2 | 1 | 1 |
| 8 | 2 | 3 | 3 | 1 |
| 9 | 1 | 2 | 2 | 1 |
| 10 | 2 | 2 | 0 | 1 |
| 11 | 2 | 1 | 0 | 1 |
| 12 | 1 | 2 | 0 | 2 |
| 13 | 2 | 1 | 1 | 1 |
| One Connection | | | | |
| 14 | 1 | 0 | 0 | 0 |
| 15 | 1 | 1 | 0 | 0 |
| 16 | 1 | 0 | 1 | 0 |
| 17 | 0 | 1 | 1 | 0 |
| 18 | 1 | 1 | 1 | 0 |
| 19 | 3 | 3 | 1 | 0 |
| 20 | 3 | 1 | 3 | 0 |
| 21 | 1 | 3 | 3 | 0 |
| 22 | 1 | 1 | 1 | 1 |
| 23 | 3 | 3 | 1 | 1 |
| 24 | 3 | 1 | 3 | 1 |
| 25 | 1 | 3 | 3 | 1 |
| 26 | 3 | 3 | 3 | 1 |
| No Connections | | | | |
| 27 | 0 | 0 | 0 | 0 |
| 28 | 3 | 3 | 0 | 0 |
| 29 | 3 | 0 | 3 | 0 |
| 30 | 0 | 3 | 3 | 0 |
| 31 | 3 | 3 | 3 | 0 |
| 32 | 3 | 3 | 3 | 3 |
| 33 | 4 | 4 | 3 | 3 |
| 34 | 4 | 3 | 4 | 3 |
| 35 | 3 | 4 | 4 | 3 |

FIGS. 5A–5D and 5G–5M show various CTHA feeds, which employ two feed lines, in accordance with embodiments of the present invention. Those CTHA feeds are applicable with, for example, the exemplary antennas 16,17 of FIGS. 4A–4B. In the CTHA feed 30 of FIG. 5A, the node A is electrically connected to the node C by electrical connection 32, although the node A of the conductor 18 may be directly electrically connected to the node C of the conductor 20. The nodes D and B in this feed are electrically connected to signal terminals 34 and 36, respectively, which are suitably structured for transmitting or receiving an antenna signal 38.

Figure 5A:
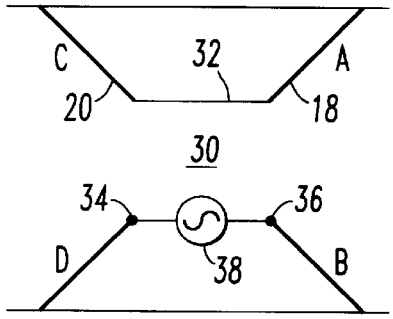
FIGS. 5A–5D are views of various CTHA feeds, which employ two feed lines in accordance with embodiments of the present invention.
Figure 5B:
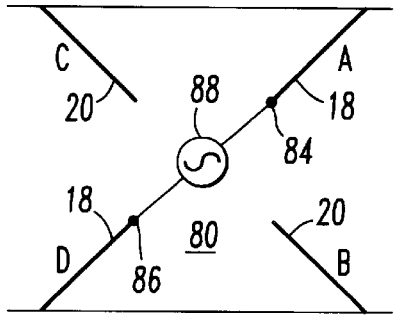
Figure 5C:
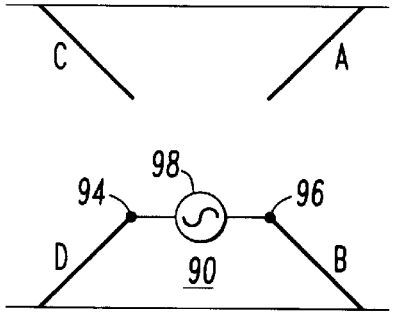
Figure 5D:
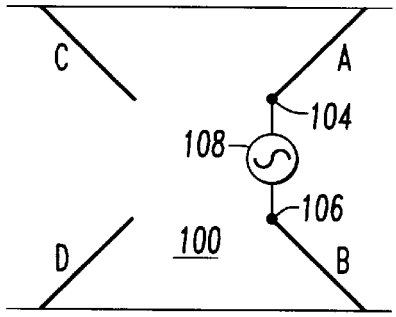
Figure 5E:
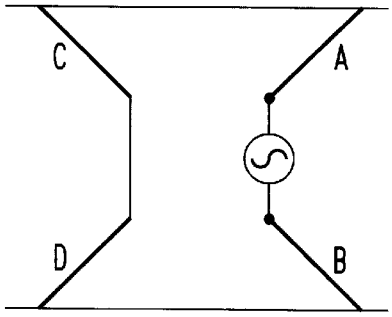
FIG.5E PRIOR ART
FIGS. 5E and 5F are views of various CTHA feeds which employ two feed lines.
Figure 5F:
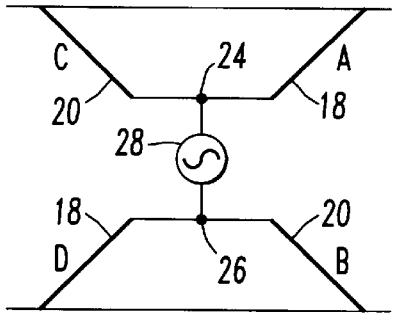
FIG.5F PRIOR ART
Figure 5G:
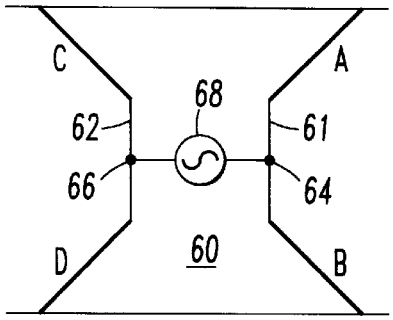
FIGS. 5G–5M are views of various CTHA feeds, which employ two feed lines in accordance with embodiments of the present invention.
Figure 5H:
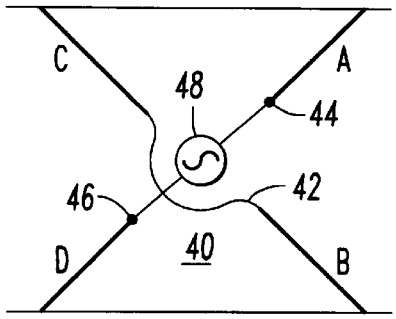

As shown in FIG. 5H, in the CTHA feed 40, the node B is electrically connected to the node C by electrical connection 42. As employed herein, electrical connections, such as 32 or 42, include separate conductors, such as insulated conductors, as well as direct electrical connections of nodes, such as B and C. The nodes A and D in this feed are electrically connected to signal terminals 44 and 46, respectively, which are structured for transmitting or receiving an antenna signal 48. For ease of reference, below, it will be understood that signal terminals are structured for transmitting or receiving a corresponding antenna signal.

Figure 5I:
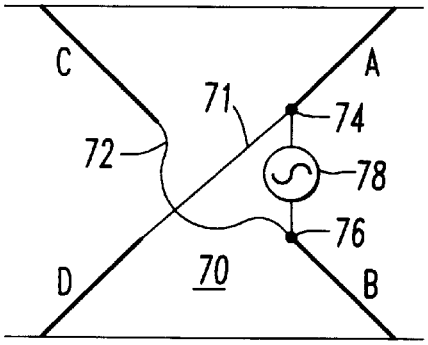
Figure 5J:
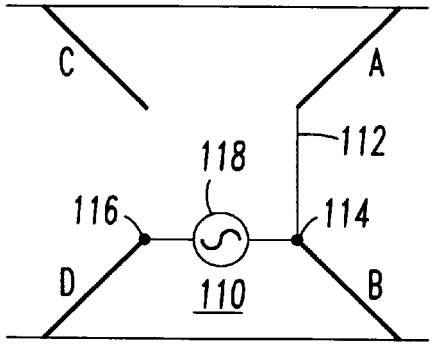
Figure 5K:
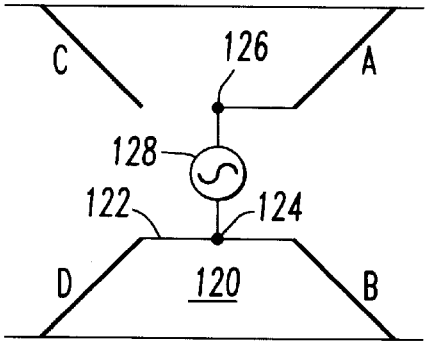
Figure 5L:
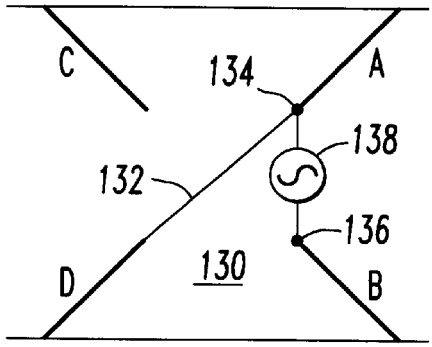
Figure 5M:
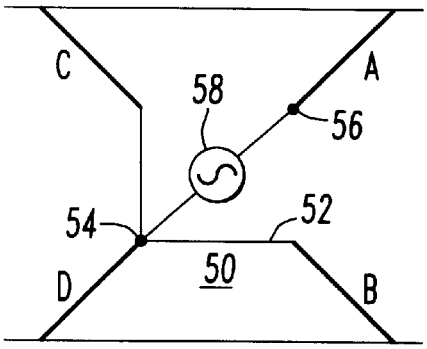

Referring to FIG. 5M, in the CTHA feed 50, the node B is electrically connected to the node D and to the node C by electrical connection 52. The nodes D and A in this feed are electrically connected to signal terminals 54 and 56, respectively, for transmitting or receiving an antenna signal 58.

In the CTHA feed 60 of FIG. 5G, the node A is electrically connected to the node B by electrical connection 61, and the node D is electrically connected to the node C by electrical connection 62. The nodes A,B and the electrical connection 61 are electrically connected to signal terminal 64, and the nodes D,C and the electrical connection 62 are electrically connected to signal terminal 66, for transmitting or receiving an antenna signal 68.

Referring to FIG. 5I, in the CTHA feed 70, the node A is electrically connected to the node D by electrical connection 71, and the node B is electrically connected to the node C by electrical connection 72. The nodes A,D and the electrical connection 71 are electrically connected to signal terminal 74, and the nodes B,C and the electrical connection 72 are electrically connected to signal terminal 76, for transmitting or receiving an antenna signal 78.

FIGS. 5B–5D, 5J–5L and 6A–6H show feeds for electromagnetic antennas, such as, for example, the exemplary antennas 16,17 of FIGS. 4A–4B, in which one, two or three of the nodes A,B,C,D are open.

In the CTHA feed 80 of FIG. 5B, the nodes A and D are electrically connected to signal terminals 84 and 86, respectively, for transmitting or receiving an antenna signal 88, and the nodes B and C are open.

In the CTHA feed 90 of FIG. 5C, the nodes D and B are electrically connected to signal terminals 94 and 96, respectively, for transmitting or receiving an antenna signal 98, and the nodes A and C are open.

In the CTHA feed 100 of FIG. 5D, the nodes A and B are electrically connected to signal terminals 104 and 106, respectively, for transmitting or receiving an antenna signal 108, and the nodes D and C are open.

In the CTHA feed 110 of FIG. 5J, the node A is electrically connected to the node B by electrical connection 112, the nodes A,B and D are electrically connected to signal terminals 114 and 116, respectively, for transmitting or receiving an antenna signal 118, and the node C is open.

In the CTHA feed 120 of FIG. 5K, the node D is electrically connected to the node B by electrical connection 122, the nodes D,B and A are electrically connected to signal terminals 124 and 126, respectively, for transmitting or receiving an antenna signal 128, and the node C is open.

In the CTHA feed 130 of FIG. 5L, the node A is electrically connected to the node D by electrical connection 132, the nodes A,D and B are electrically connected to signal terminals 134 and 136, respectively, for transmitting or receiving an antenna signal 138, and the node C is open.

In addition to showing feeds for electromagnetic antennas, such as, for example, the exemplary antennas 16,17 of FIGS. 4A–4B, in which one, two or three of the nodes A,B,C,D are open (FIGS. 6A–6H), FIGS. 6A–6M show CTHA feeds, which employ only one direct feed connection in accordance with other embodiments of the present invention.

Figure 6A:
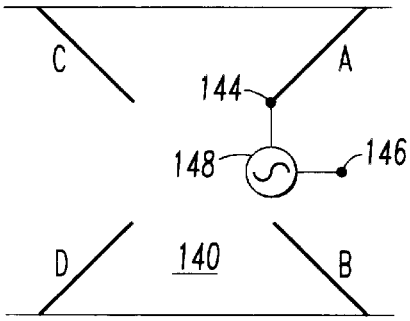
FIGS. 6A–6M are views of various CTHA feeds, which employ only one direct feed connection in accordance with embodiments of the present invention.

In the CTHA feed 140 of FIG. 6A, the nodes D,B,C are open, a signal terminal 144 is electrically connected to the node A, and a signal terminal 146 is structured for connection to a cooperative antenna structure such as, for example, the ground plane 147 of FIG. 41, the reflector 148 of FIG. 42, the other CTHA 149 of FIG. 43, or any other antenna structure. For convenience of reference, it will be understood that signal terminals, such as 144,146, are for transmitting or receiving an antenna signal, such as 148.

Figure 6B:
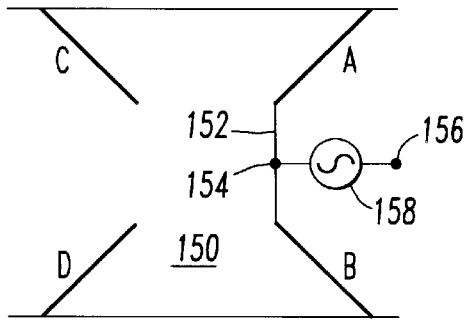

In the CTHA feed 150 of FIG. 6B, the node A is electrically connected to the node B by an electrical connection 152, the nodes D and C are open, a first signal terminal 154 is electrically connected to the nodes A,B, and a second signal terminal 156 is structured for connection to a cooperative antenna structure. The terminals 154,156 are for an antenna signal 158.

Figure 6C:
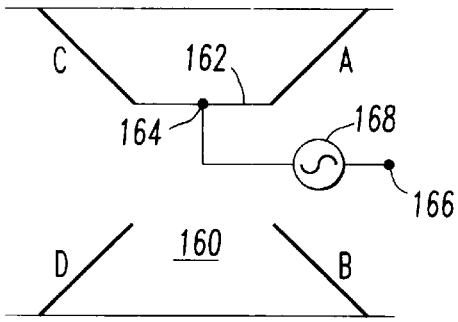

In the CTHA feed 160 of FIG. 6C, the node A is electrically connected to the node C by an electrical connection 162, the nodes D and B are open, a first signal terminal 164 is electrically connected to the nodes A,C, and a second signal terminal 166 is structured for connection to a cooperative antenna structure. The terminals 164,166 are for an antenna signal 168.

Figure 6D:
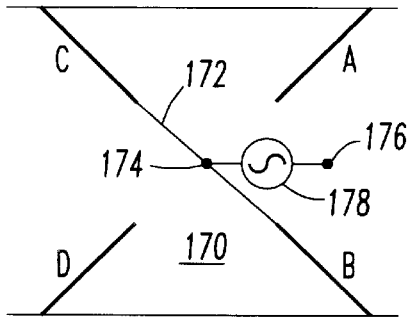

In the CTHA feed 170 of FIG. 6D, the node B is electrically connected to the node C by an electrical connection 172, the nodes A and D are open, a first signal terminal 174 is electrically connected to the nodes B,C, and a second signal terminal 176 is structured for connection to a cooperative antenna structure. The terminals 174,176 are for an antenna signal 178.

Figure 6E:
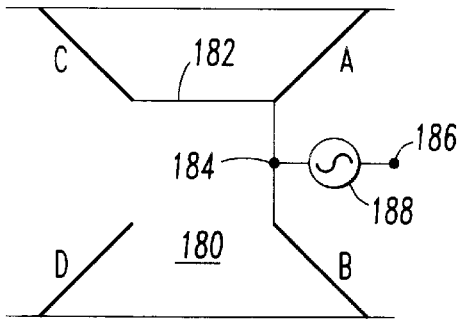

In the CTHA feed 180 of FIG. 6E, the node A is electrically connected to the nodes B and C by an electrical connection 182, the node D is open, a first signal terminal 184 is electrically connected to the nodes A,B,C, and a second signal terminal 186 is structured for connection to a cooperative antenna structure. The terminals 184,186 are for an antenna signal 188.

Figure 6F:
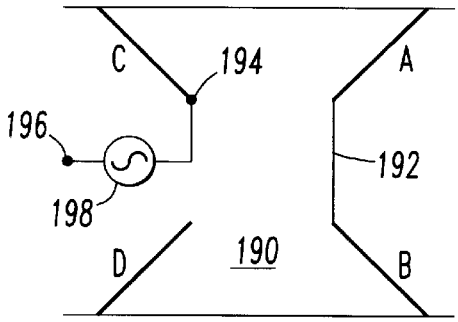

In the CTHA feed 190 of FIG. 6F, the node A is electrically connected to the node B by an electrical connection 192, the node D is open, a first signal terminal 194 is electrically connected to the node C, and a second signal terminal 196 is structured for connection to a cooperative antenna structure. The terminals 194,196 are for an antenna signal 198.

Figure 6G:
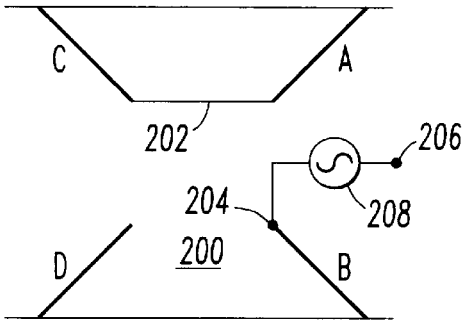

In the CTHA feed 200 of FIG. 6G, the node A is electrically connected to the node C by an electrical connection 202, the node D is open, a first signal terminal 204 is electrically connected to the node B, and a second signal terminal 206 is structured for connection to a cooperative antenna structure. The terminals 204,206 are for an antenna signal 208.

Figure 6H:
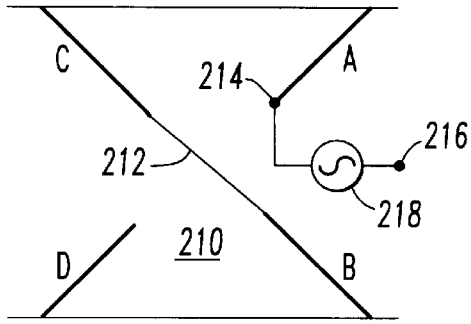

In the CTHA feed 210 of FIG. 6H, the node B is electrically connected to the node C by an electrical connection 212, the node D is open, a first signal terminal 214 is electrically connected to the node A, and a second signal terminal 216 is structured for connection to a cooperative antenna structure. The terminals 214,216 are for an antenna signal 218.

Figure 6I:
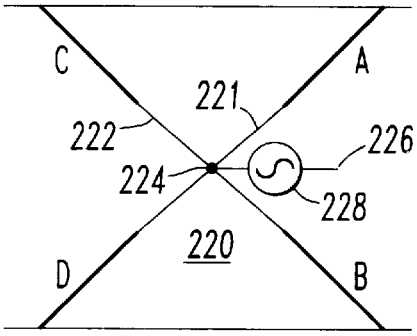

In the CTHA feed 220 of FIG. 6I, the node A is electrically connected to the node D by an electrical connection 221, the node B is electrically connected to the node C by an electrical connection 222, a first signal terminal 224 is electrically connected to the nodes A,B,C,D, and a second signal terminal 226 is structured for connection to a cooperative antenna structure. The terminals 224,226 are for an antenna signal 228.

Figure 6J:
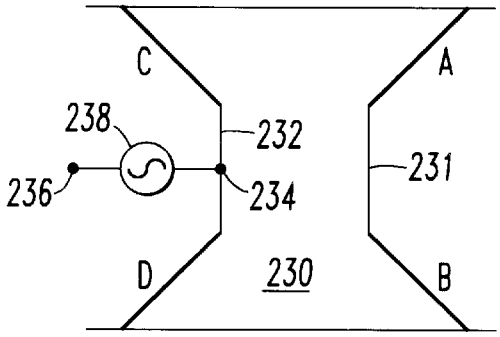

In the CTHA feed 230 of FIG. 6J, the node A is electrically connected to the node B by an electrical connection 231, the node D is electrically connected to the node C by an electrical connection 232, a first signal terminal 234 is electrically connected to the nodes D,C, and a second signal terminal 236 is structured for connection to a cooperative antenna structure. The terminals 234,236 are for an antenna signal 238.

Figure 6K:
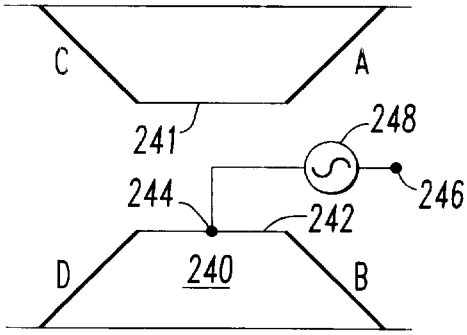

In the CTHA feed 240 of FIG. 6K, the node A is electrically connected to the node C by an electrical connection 241, the node D is electrically connected to the node B by an electrical connection 242, a first signal terminal 244 is electrically connected to the nodes D,B, and a second signal terminal 246 is structured for connection to a cooperative antenna structure. The terminals 244,246 are for an antenna signal 248.

Figure 6L:
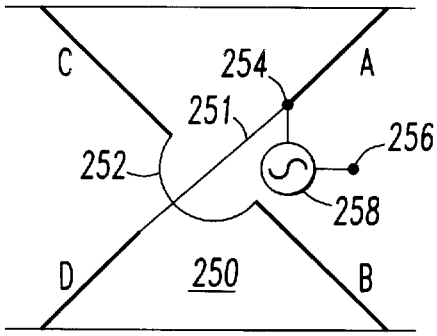

In the CTHA feed 250 of FIG. 6L, the node A is electrically connected to the node D by an electrical connection 251, the node B is electrically connected to the node C by an electrical connection 252, a first signal terminal 254 is electrically connected to the nodes A,D, and a second signal terminal 256 is structured for connection to a cooperative antenna structure. The terminals 254,256 are for an antenna signal 258.

Figure 6M:
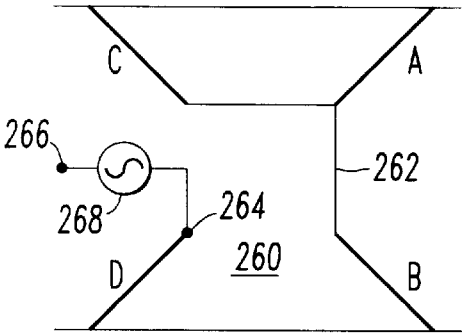

In the CTHA feed of FIG. 6M, the node A is electrically connected to the nodes B,C by electrical connection 262, signal terminal 264 is electrically connected to the node D, and signal terminal 266 is structured for connection to a cooperative antenna structure. The terminals 264,266 are for an antenna signal 268.

Figure 7A:
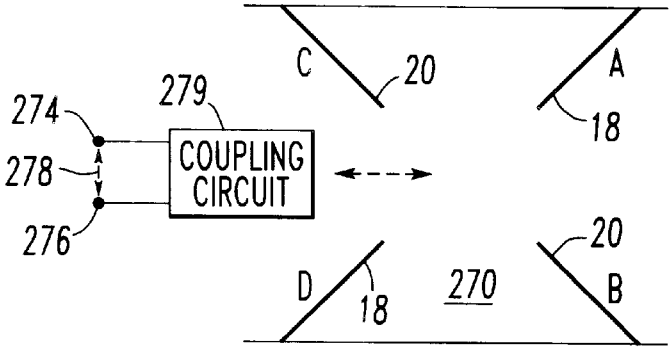
FIGS. 7A–7G and 7I are views of various CTHA feeds, which employ no direct feed connection in accordance with embodiments of the present invention.
Figure 7B:
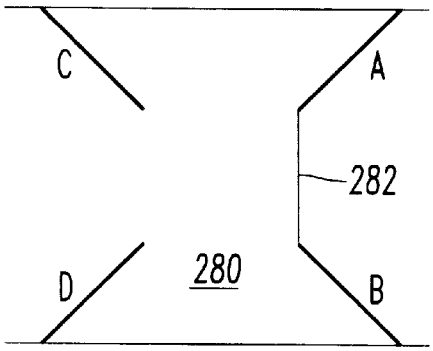
Figure 7C:
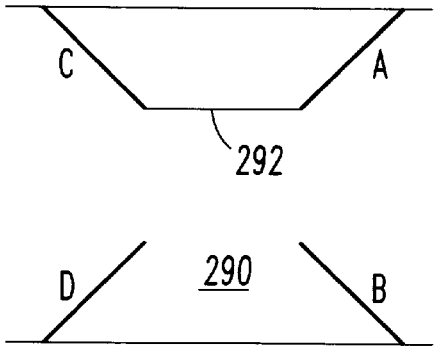

FIGS. 7A–7I show various CTHA feeds, which employ no direct feed connection. In particular, FIG. 7A shows CTHA feed 270 in which signal terminals 274,276 are structured for transmitting or receiving an antenna signal 278. A suitable circuit 279 couples the antenna signal 278 to or from conductors, such as the exemplary insulated conductors 18,20 of FIGS. 4A–4B.

In FIGS. 7A–7E, one, two or all four of the nodes A,B,C,D of the CTHA feeds 270,280,290,300,310 are open. Like the feed 270 of FIG. 7A, it is understood that the CTHA feeds 270,280,290,300,310,320,330,340,350 of FIGS. 7B–71, respectively, each employ a suitable coupling circuit, such as 279 of FIG. 7A.

Figure 7D:
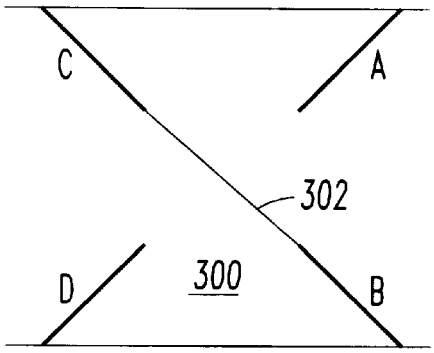
Figure 7E:
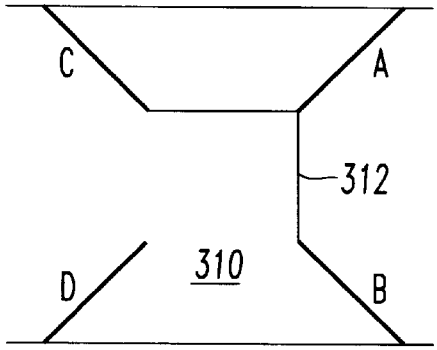
Figure 7F:
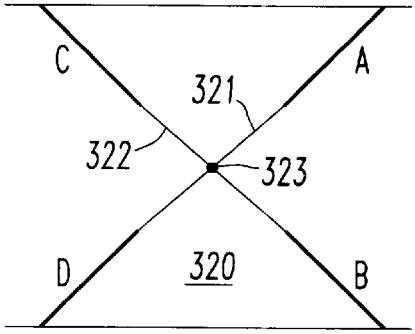

All of the nodes A,B,C,D of the feed 270 of FIG. 7A are open. In the feed 280 of FIG. 7B, the node A is electrically connected to the node B by electrical connection 282, and the nodes D,C are open. In the feed 290 of FIG. 7C, the node A is electrically connected to the node C by electrical connection 292, and the nodes D,B are open. FIG. 7D shows the feed 300, in which node B is electrically connected to the node C by electrical connection 302, and the nodes A,D are open. In the feed 310 of FIG. 7E, the node A is electrically connected to the node B and the node C by electrical connection 302, and the node D is open.

In FIGS. 7F–7I, the nodes A,B,C,D of these CTHA feeds are interconnected with at least one other node. In the feed 320 of FIG. 7F, the node A is electrically connected to the node D by electrical connection 321, and the node B is electrically connected to the node C by electrical connection 322. In turn, the nodes A,D are electrically connected (e.g., at 323) to the nodes B,C. In the feed 330 of FIG. 7G, the node A is electrically connected to the node B by electrical connection 331, and the node D is electrically connected to the node C by electrical connection 332. In the feed 340 of FIG. 7H, the node A is electrically connected to the node C by electrical connection 341, and the node D is electrically connected to the node B by electrical connection 342.

Figure 7G:
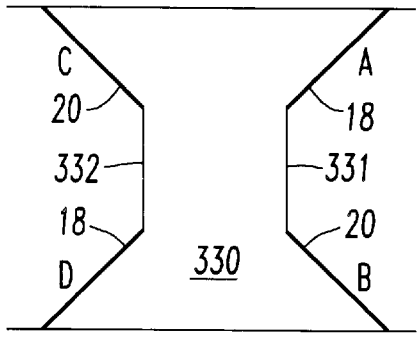
Figure 7H:
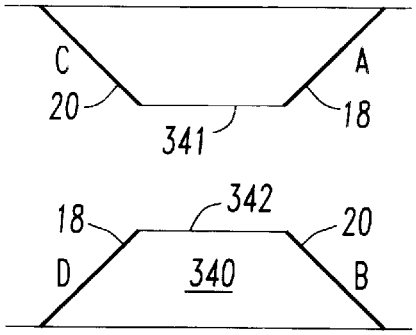
FIG. 7H PRIOR ART
FIG. 7H is a view of a CTHA feed, which employs no direct feed connection.
Figure 7I:
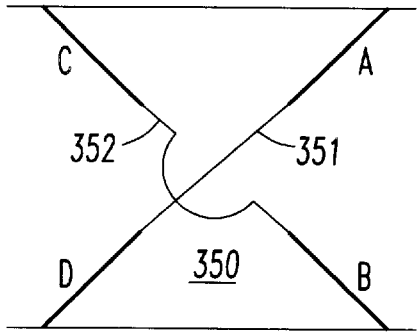

In the embodiment of FIG. 7G, the exemplary electrical connections 331,332, and the exemplary insulated conductors 18,20, include a single insulated conductor which forms a single endless conductive path around and over the surface, such as the exemplary toroidal surface 23 of FIG. 4A.

In the feed 350 of FIG. 71, the node A is electrically connected to the node D by electrical connection 351, and the node B is electrically connected to the node C by electrical connection 352.

EXAMPLES 1–8

The following examples illustrate the behavior of CTHAs having feeds #1–#8 (i.e., FIGS. 5A–5H, respectively), as set forth in Table 2. These feeds are modeled in NEC 4 (ie., Numerical Electromagnetics Code, Version 4, maintained by Los Alamos National Laboratory). In these examples, an exemplary 10-turn CTHA has a major radius of 1.05 in (0.413 cm), a minor radius of 0.185 in. (0.0728 cm), and a wire diameter of 0.0143 in. (0.00570 cm), and the exemplary antennas employ "polar crossings" (i.e., wire crossings above and below) as shown in FIG. 4A, although a wide range of antenna geometries, sizes, and wire sizes may be employed.

Figure 8:
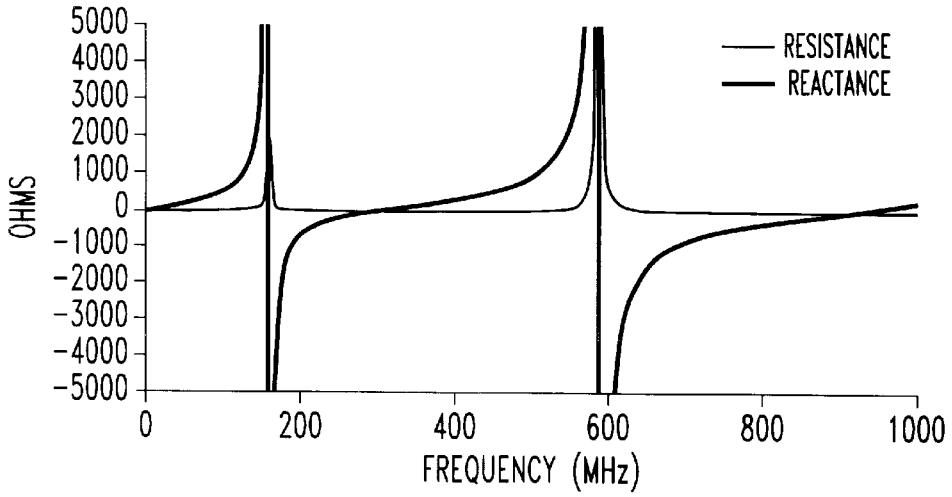
FIGS. 8–15 are plots of the impedance spectrums for the feeds of FIGS. 5A–5H.

The conventional CTHA feed of FIG. 5F is employed as the basis of comparison for much of the following discussion. FIGS. 8–15 are plots of the impedance spectrums for the CTHA feeds of FIGS. 5A–5H, respectively. FIG. 8 shows the impedance spectrum for feed 30 of FIG. 5A, which has a reduction in the frequency of the first resonance due to the effective doubling of the wire length between the two feed points 34,36. This is accomplished by electrically connecting the nodes A,C, but feeding the other two nodes D,B. The exemplary feed 30 configuration has a resonance at 300 MHz, as opposed to an anti-resonance, thereby improving impedance matching bandwidth, since the change of impedance with respect to frequency is less rapid at a resonance, as opposed to an anti-resonance. FIG. 8 and FIG. 13 are based upon the same physical antenna, except that different feeds are employed. The feed 30 configuration greatly reduces the input impedance at 300 MHz, thereby improving impedance matching characteristics. Furthermore, as discussed below, the gain and shape of the corresponding radiation pattern is typically affected by the feed configuration to, thereby, meet various communication needs.

Figure 9:
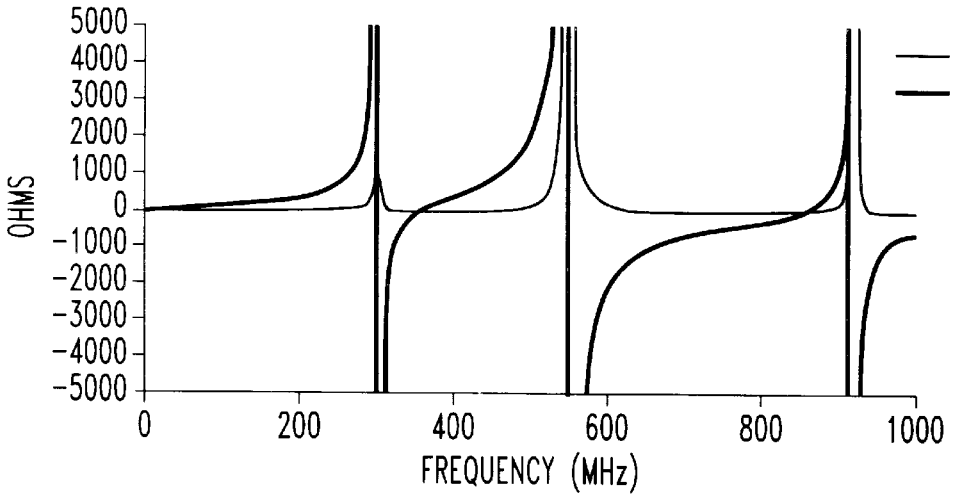

FIG. 9 shows the impedance spectrum for feed 80 of FIG. 5B, which leaves the first resonance essentially the same with respect to the feed of FIG. 5F, but significantly affects the regular intervals of subsequent resonances. It is believed that this is of importance when operating the exemplary antenna at higher resonances. Feed 80 is essentially a single toroidal helix, as formed by the exemplary conductor 18, which has a second contrawound toroidal helix, as formed by the exemplary conductor 20, passively coupled thereto. It is believed that the irregularity in the impedance spectrum of FIG. 9 coincides with varying degrees of coupling between the CTHA wires.

Figure 10:
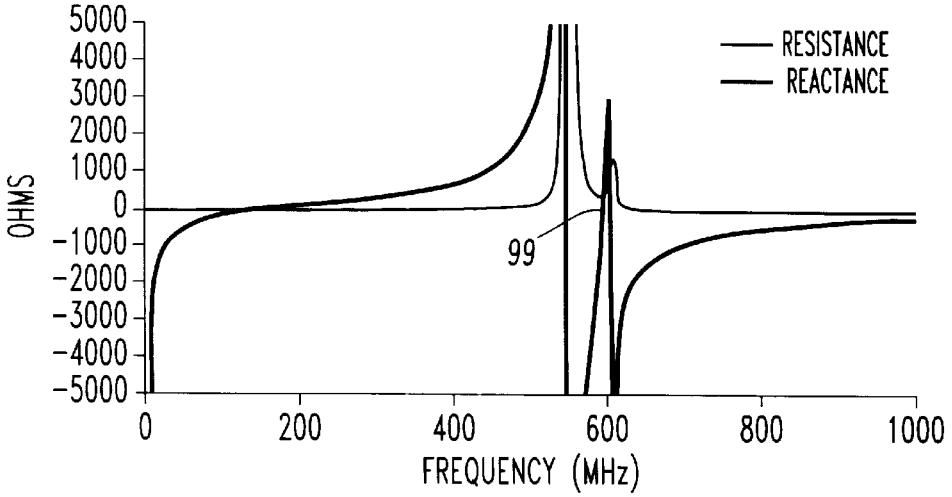

The impedance spectrum of feed 90 in FIG. 10 is relatively chaotic from the perspective of regular interval resonances, although it is believed that it has a useful design point at its third resonance 99.

Figure 11:
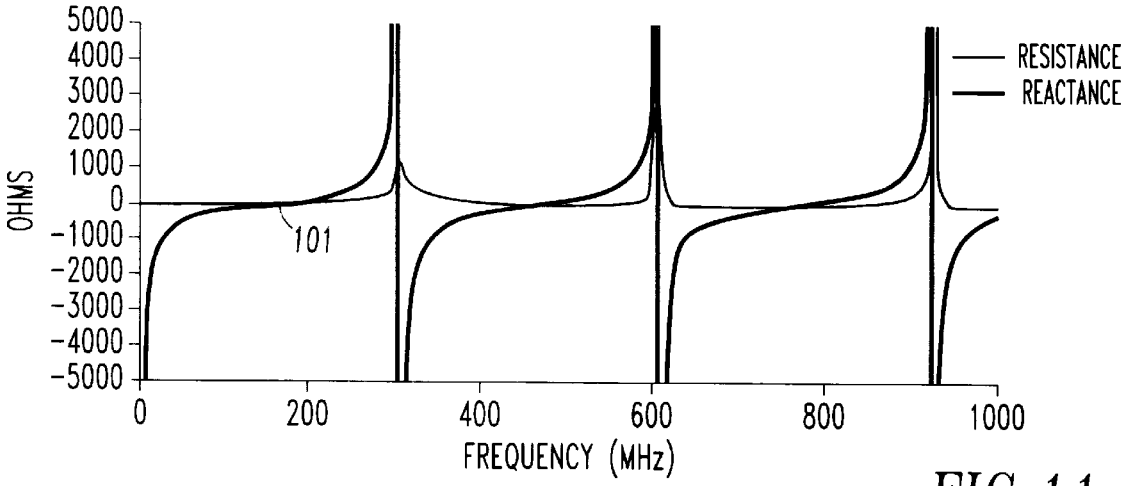

FIG. 11 shows an impedance spectrum for feed 100 of FIG. 5D, which switches to a low impedance first resonance 101. This is possible by leaving the nodes D,C of FIG. 5D unconnected. This spectrum essentially changes a low current feed (e.g., such as a loop) to a high current feed (e.g., such as a dipole), and exhibits regularly spaced resonances at 150 MHz intervals. It is believed that this impedance spectrum may be advantageous at 300 MHz. Furthermore, it is believed that it has similar currents with respect to the feed of FIG. 5F and, therefore, should advantageously produce vertically polarized energy from an exemplary horizontal toroid.

Figure 12:
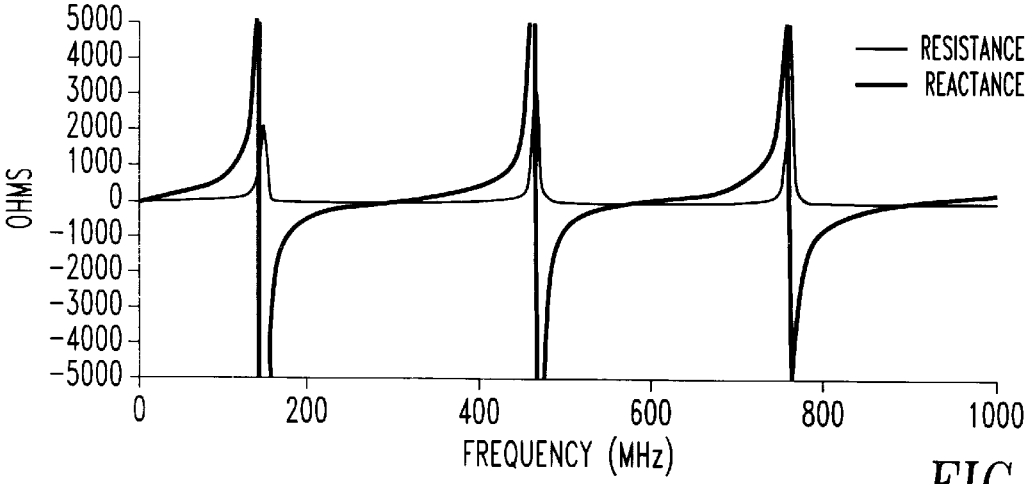
FIG. 12 PRIOR ART
Figure 13:
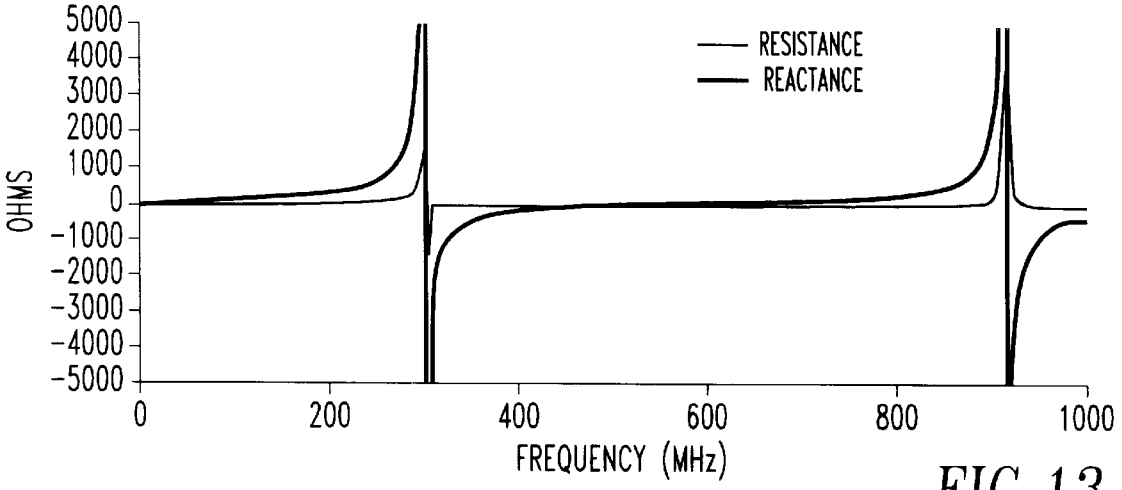
FIG. 13 PRIOR ART
Figure 14:
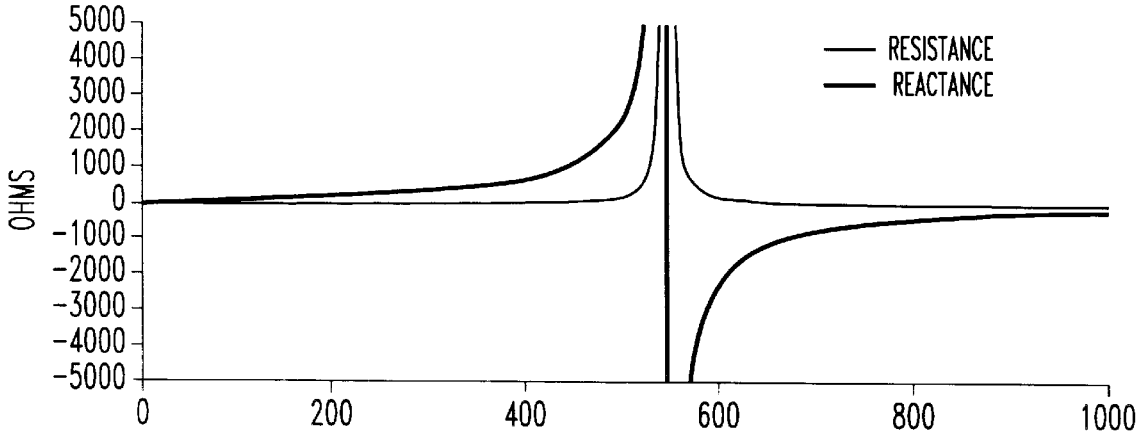
Figure 15:
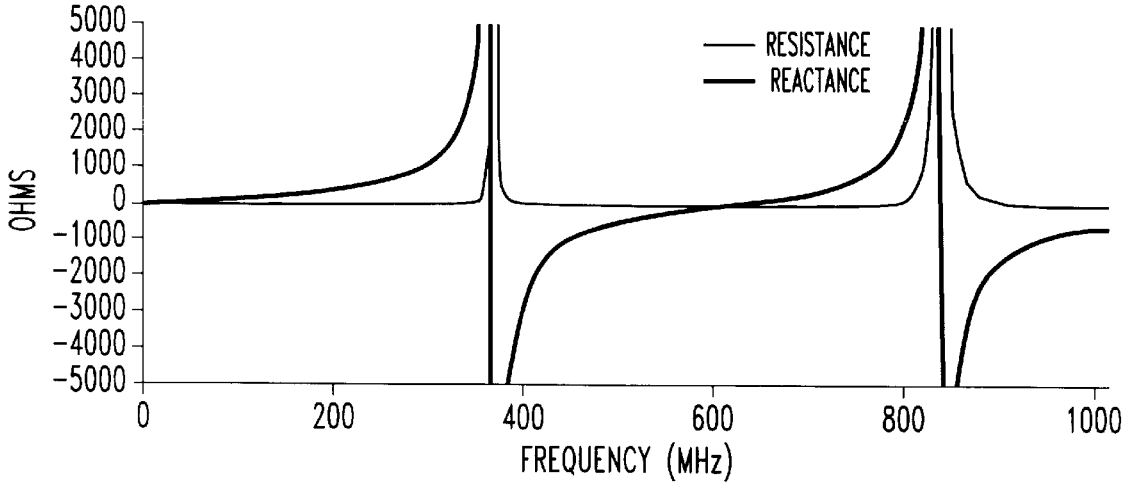

FIG. 12 shows the impedance spectrum of the feed of FIG. 5E, which has regular interval resonances beginning at 150 MHz due to the effective increase in wire length between the two feed points at nodes A,B.

Although the feed of FIG. 5F (the corresponding impedance spectrum is shown in FIG. 13) imposes contra-currents in the contrawindings 18,20 and, hence, augments magnetic fields at the expense of azimuthal phi-polarized electric fields, the feed 60 of FIG. 5G imposes similar currents in the contrawindings, thereby maximizing azimuthal phi-polarized electric fields at the expense of magnetic fields. It is believed that this feed is advantageous for horizontally polarized communication and is especially beneficial at vertically polarized radiation in the vertical position (i.e., when employed in a "lollipop mode"). Of particular interest is the relatively large change in the first resonance, as shown by the corresponding impedance spectrum of FIG. 14, which is due to a greatly changed effective velocity factor when employing similar currents.

The feed 40 of FIG. 5H is similar to the feed 80 of FIG. 5B in that there is one driven helix and one passively coupled helix. However, by closing the second helix (i.e., between the nodes B,C), the coupling now follows a more uniform behavior as shown in the impedance spectrum of FIG. 15.

The exemplary feeds 30 (FIGS. 5A and 8), 80 (FIGS. 5C and 10), and 100 (FIGS. 5D and 11) lead to a lowering of the first resonance frequency relative to the feed of FIGS. 5F and 13, while feeds 60 (FIGS. 5G and 14) and 40 (FIGS. 5H and 15) increase the first resonance frequency, and feed 80 (FIGS. 5B and 9) maintains that first resonance frequency.

Figure 16:
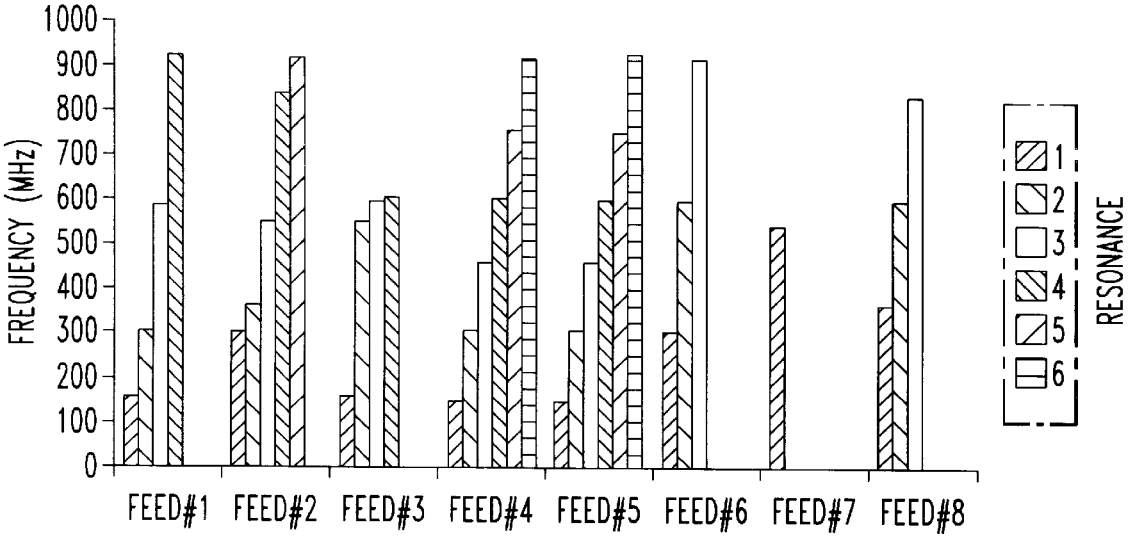
FIG. 16 is a plot of calculated resonant frequencies for a CTHA having the feeds of FIGS. 5A–5H.

FIG. 16 shows a plot of calculated resonant frequencies between 5 and 1000 MHz for a CTHA having the feeds of FIGS. 5A–5H. The impedance spectrum for the feed #6 of FIG. 5F has regular interval resonances starting near 300 MHz and alternates between high impedance and low impedance throughout the spectrum. The first resonance refers to the first crossing of the x-axis by the reactance portion of the impedance, even if that crossing represents a discontinuity or anti-resonance. In this plot, the feeds of FIGS. 5D–SF maintain evenly spaced resonance intervals, while the feeds of FIGS. 5A–5C, 5G and 5H vary to some extent.

Table 3, below, shows the computed resonant frequencies (MHz) for the feeds of FIGS. 5A–5H.

TABLE 3

| Resonance | Feed #1 | Feed #2 | Feed #3 | Feed #4 | Feed #5 | Feed #6 | Feed #7 | Feed #8 |
|---|---|---|---|---|---|---|---|---|
| 1 | 156.67 | 302.59 | 157.14 | 148.82 | 141.51 | 302.51 | 542.40 | 360.80 |
| 2 | 304.96 | 361.45 | 548.16 | 302.49 | 305.23 | 597.26 | | 598.95 |
| 3 | 587.89 | 547.66 | 595.75 | 457.02 | 456.70 | 917.73 | | 828.84 |
| 4 | 926.01 | 843.38 | 601.23 | 602.86 | 599.60 | | | |
| 5 | | 916.42 | | 756.71 | 753.26 | | | |
| 6 | | | | 916.67 | 924.84 | | | |

Figure 17:
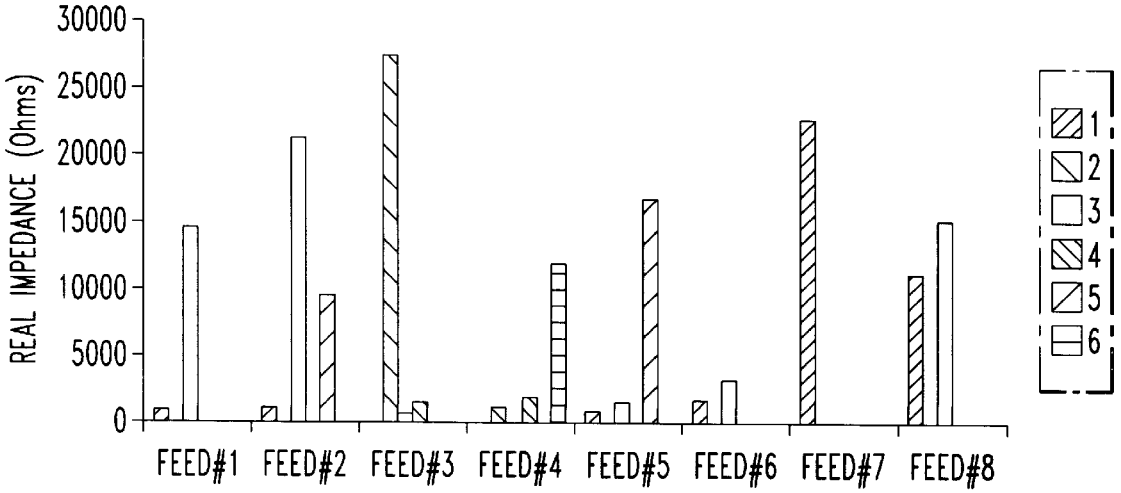
FIG. 17 is a plot of real impedance at various resonances for the feeds of FIGS. 5A–5H.

FIG. 17 is a plot of the real part of the impedance at various resonances between 5 and 1000 MHz for the feeds of FIGS. 5A–5H, respectively. The feeds of FIGS. 5A, 5B, and 5E–5H start at relatively high impedance resonances (i.e., the first resonance looking left to right—the first crossing of the reactance across the frequency axis is referred to as a resonance) (see FIGS. 8, 9 and 12–15, respectively). In this regard, if the resistance curve has a relatively high value at the place the reactance crosses the frequency axis, then this is referred to as a high impedance resonance. Otherwise, if, at the resonance, the resistance curve has a relatively low value, then this is referred to as a low impedance resonance. Alternatively, some might call the high impedance resonance an "anti-resonance". Each impedance spectrum generally shows a repeating pattern of high and low impedance resonances. Some start low and then proceed to high, low, high, etc.; while others start high and then proceed to low, high, low, etc. Some of the feed arrangements disclosed herein are such that the magnetic fields are cancelled and the electric fields are reinforced for applications where a loop antenna pattern is desired, but is smaller in size due to its helical nature.

Figure 18:
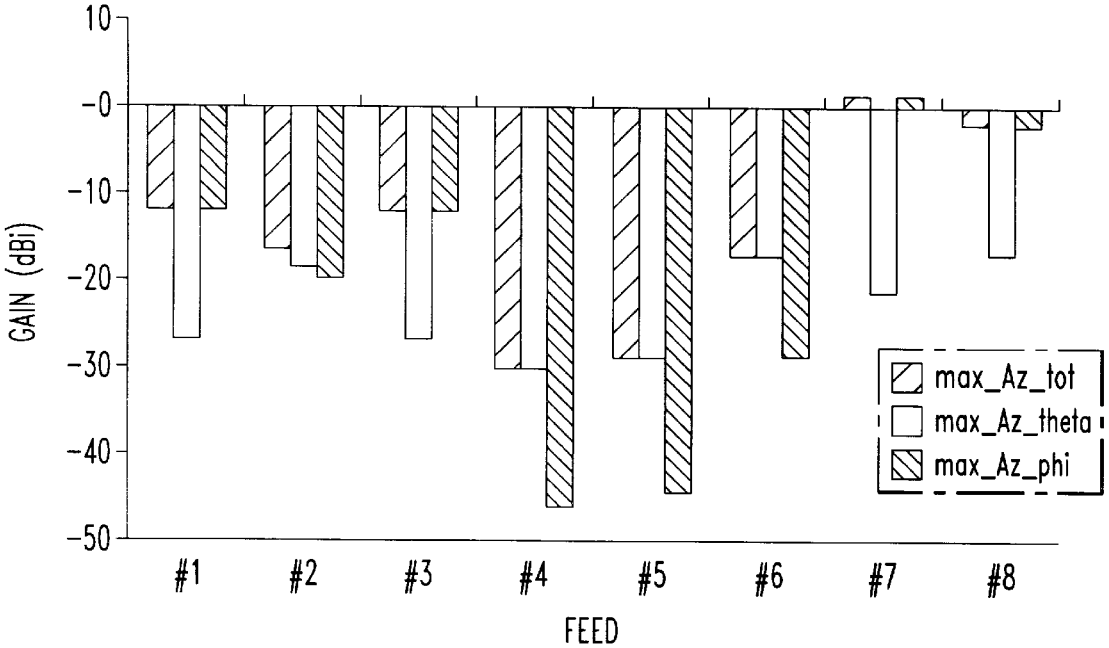
FIG. 18 is a plot of maximum azimuthal gains for the feeds of FIGS. 5A–5H at the respective first resonances.

FIG. 18 is a plot of maximum azimuthal gains for the feeds of FIGS. 5A–5H, respectively, at the respective first resonances. An important design consideration is the gain of an antenna. This plot provides an interesting comparison for a fixed size antenna. However, in most applications, the frequency is fixed and a different sized antenna would be employed for each feed in order to provide the same first resonance. Hence, better comparison of the feeds may be obtained. From a pure gain perspective, the feed (#7) of FIG. 5G is preferred to the extent that energy being completely phi polarized (max_Az_phi) is desired. In that regard, such a polarization may solve various communications problems (e.g., the CTHA acts like a loop antenna, but is smaller than a traditional loop), although it deviates from the traditional CTHA concept of a horizontal structure, which produces vertically polarized radiation.

Figure 19:
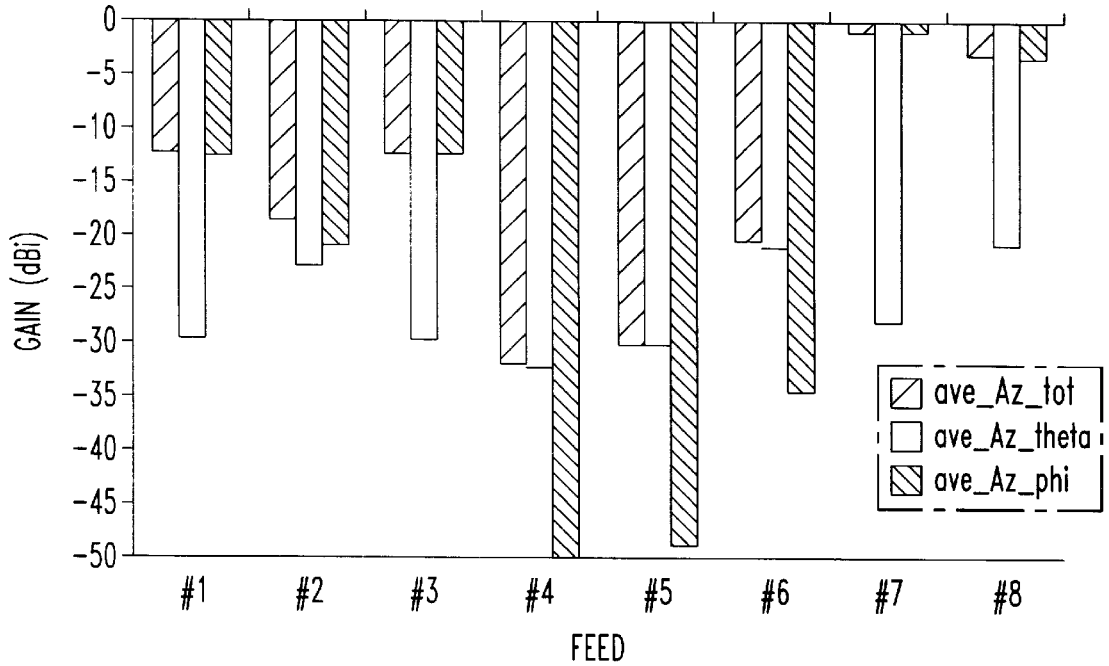
FIG. 19 is a plot of average azimuthal gains for the feeds of FIGS. 5A–5H at the respective first resonances.

FIG. 19 is a plot of average azimuthal gains for the feeds of FIGS. 5A–5H, respectively, at the respective first resonances.

Figure 20:
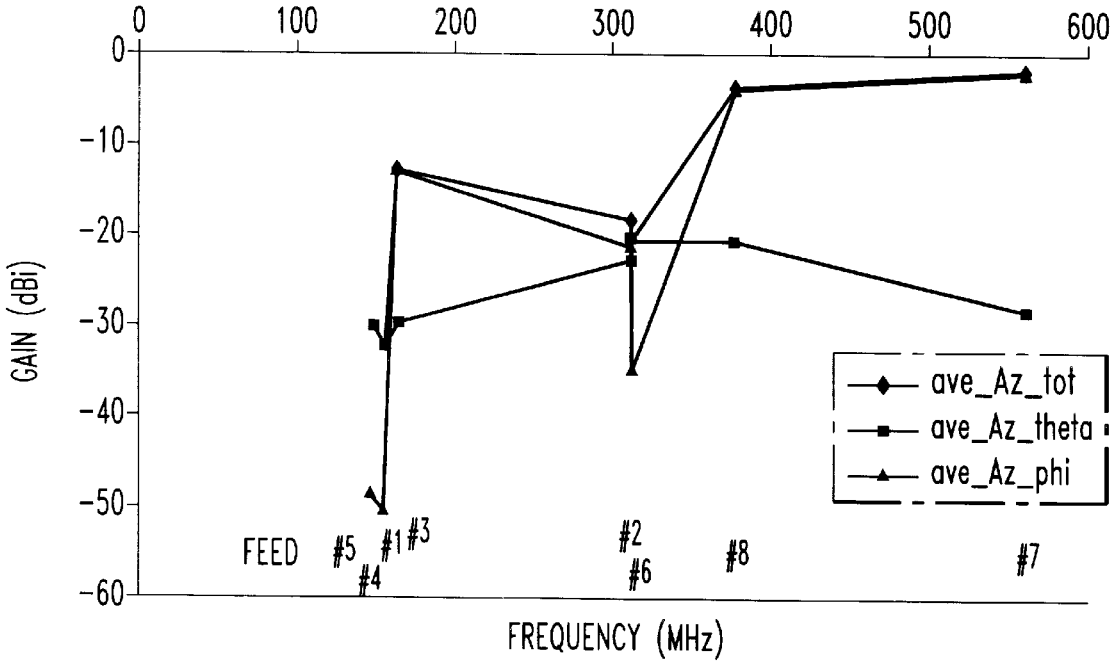
FIG. 20 is a plot of average azimuthal gains for the feeds of FIGS. 5A–5H at the respective first resonances as shown at the frequency of those resonances.
Figure 21A:
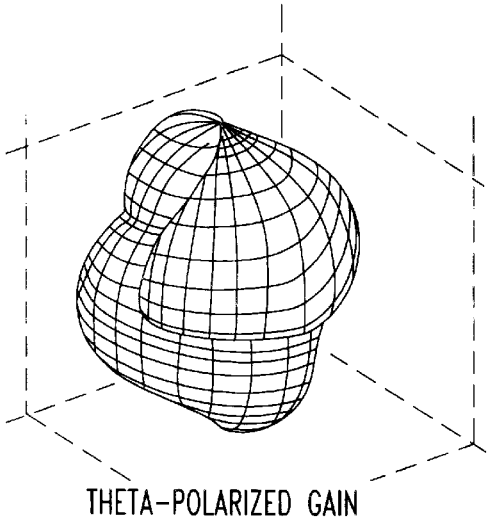
FIGS. 21A–21C through 28A–28C are far-field plots of theta-polarized gain (FIGS. 21A–28A), phi-polarized gain (FIGS. 21B–28B), and total gain (FIGS. 21C–28C) for the feeds of FIGS. 5A–5H, respectively, at the respective first resonances.
Figure 21B:
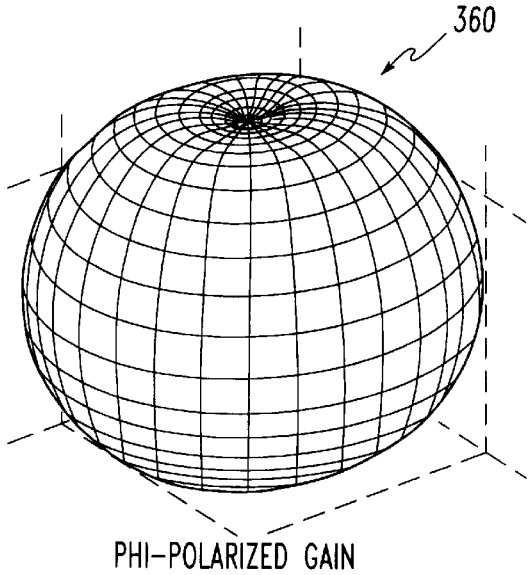
Figure 21C:
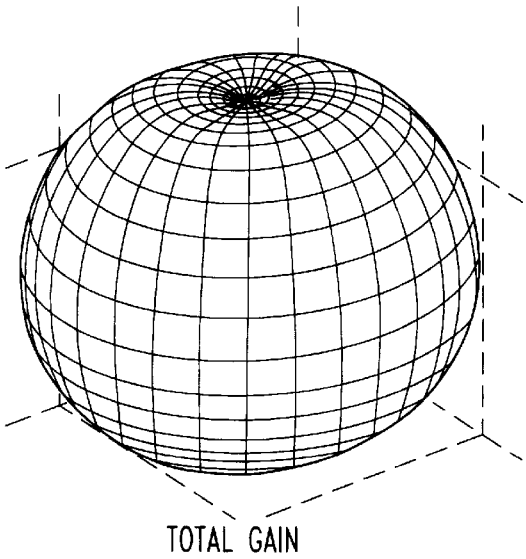

FIG. 20 is a plot of average azimuthal gains for the feeds of FIGS. 5A–5H, respectively, at the respective first resonances as shown at the frequency of those resonances. This plot shows that the variation in average gain ($\theta$, $\phi$, and total) at the respective first resonances is due to changes in frequency of these resonances. In general, if frequency were the only factor, then all of the points would fall on the same curve. Since this is not the case, then it is believed that there are relative efficiency differences for the respective feed configurations of FIGS. 5A–5H.

Figure 22A:
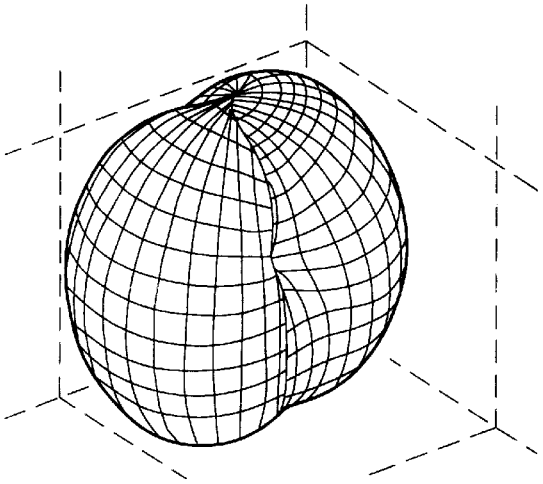
Figure 22B:
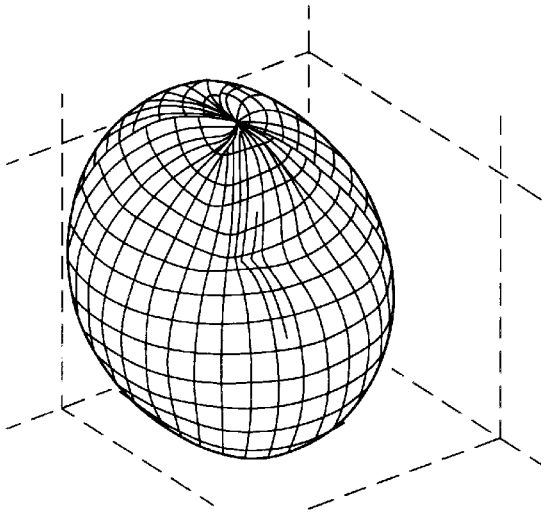
Figure 22C:
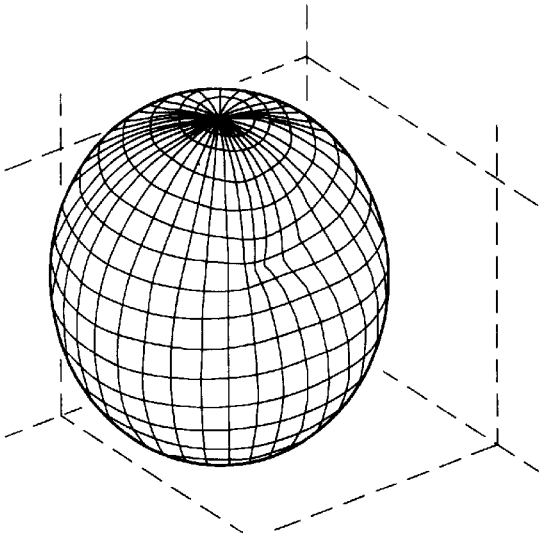
Figure 23A:
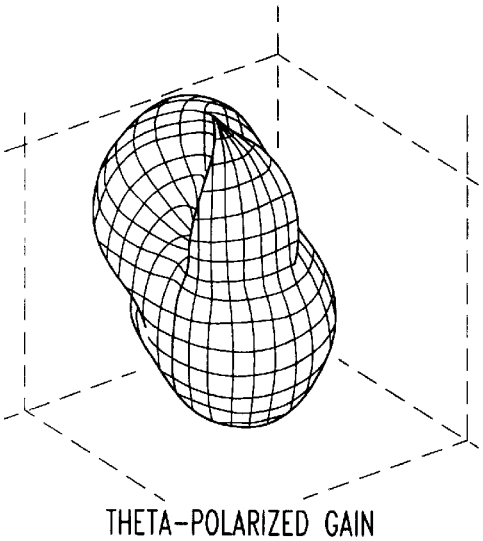
Figure 23B:
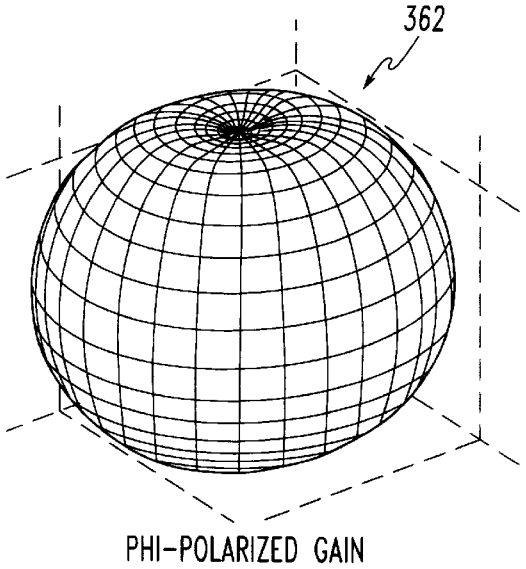
Figure 23C:
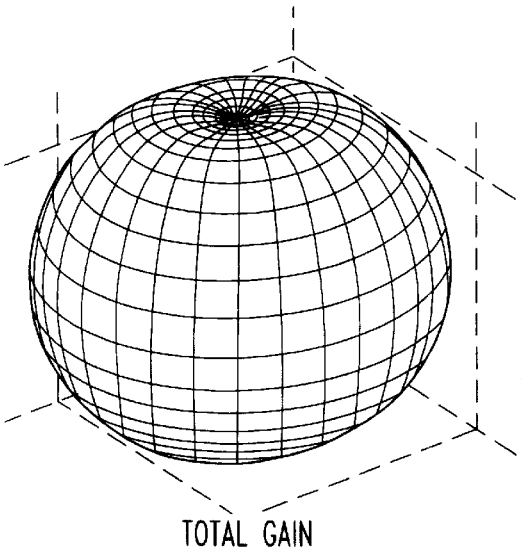
Figure 24A:
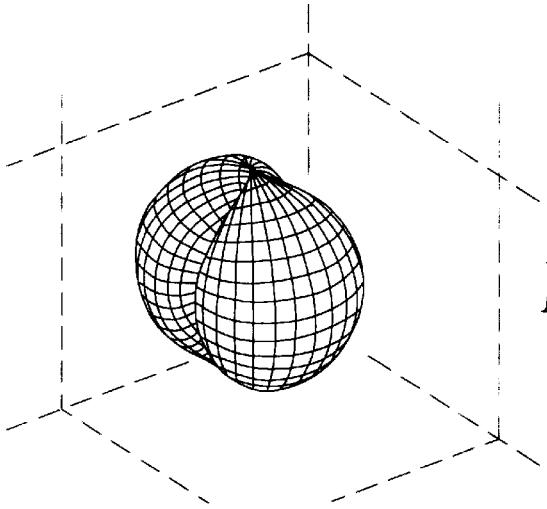
Figure 24B:
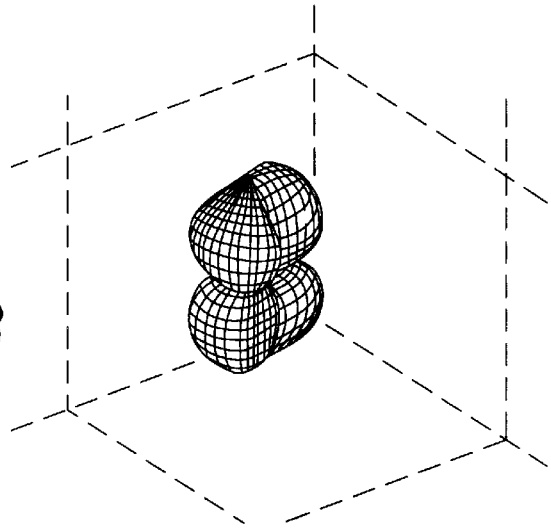
Figure 24C:
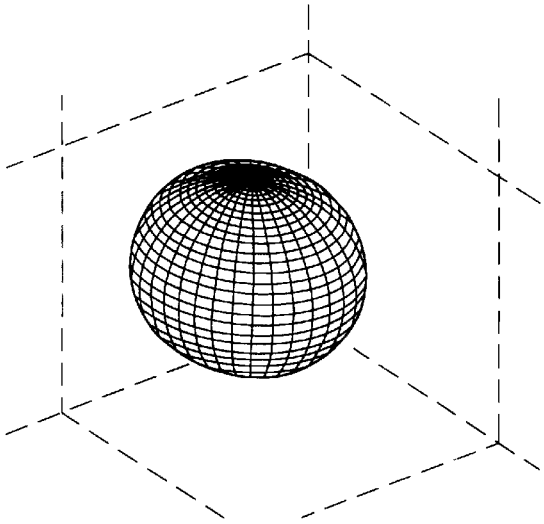
Figure 25A:
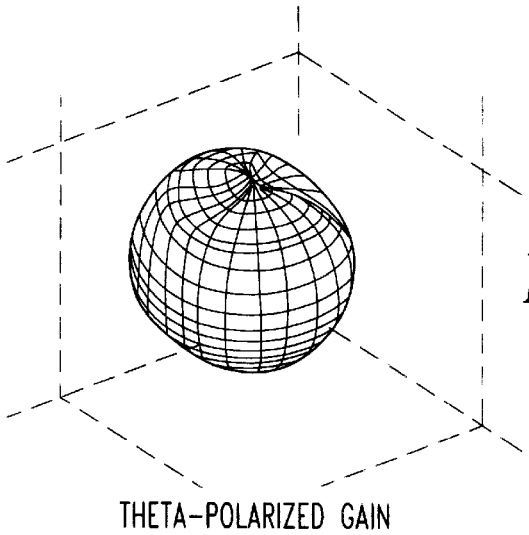
FIG.25A PRIOR ART
Figure 25B:
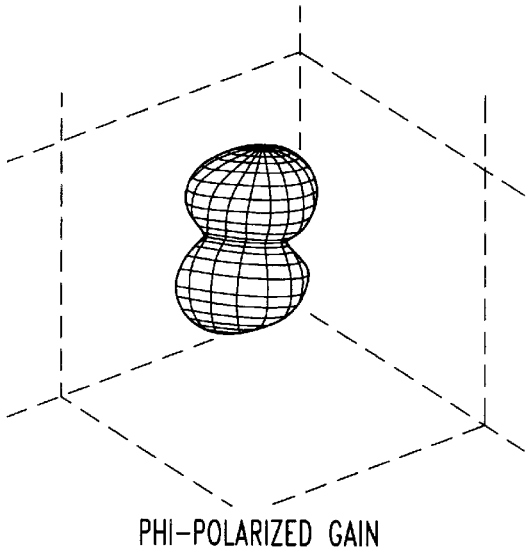
FIG.25B PRIOR ART
Figure 25C:
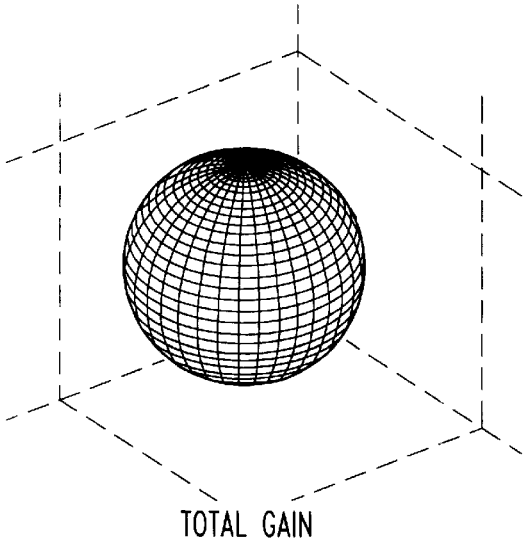
FIG.25C PRIOR ART
Figure 26A:
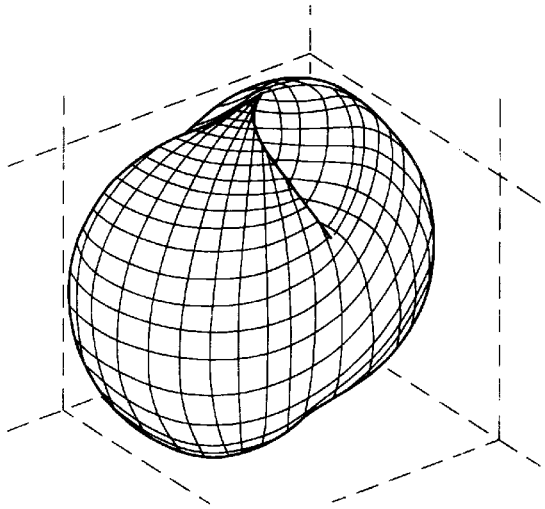
FIG.26A PRIOR ART
Figure 26B:
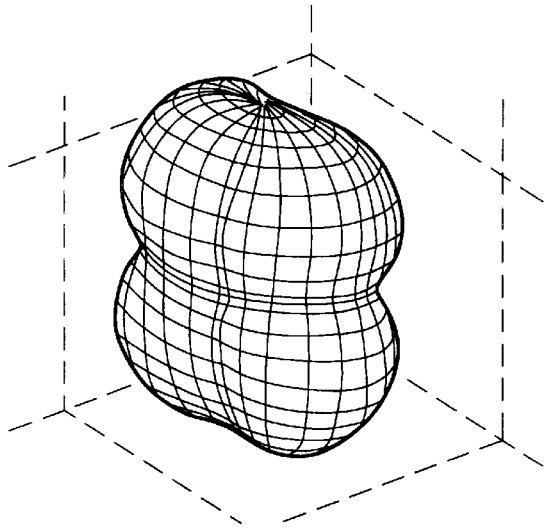
FIG.26B PRIOR ART
Figure 26C:
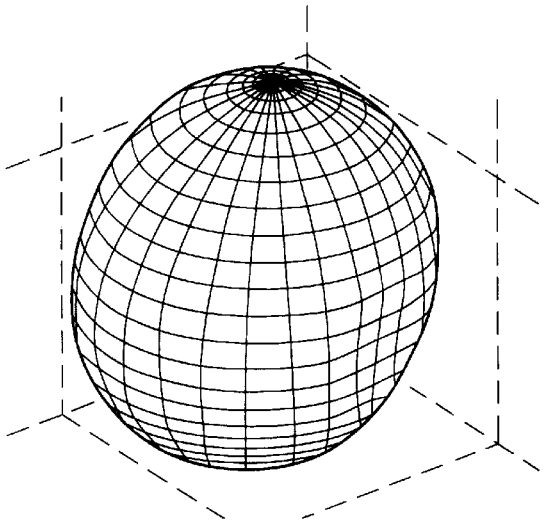
FIG.26C PRIOR ART
Figure 27A:
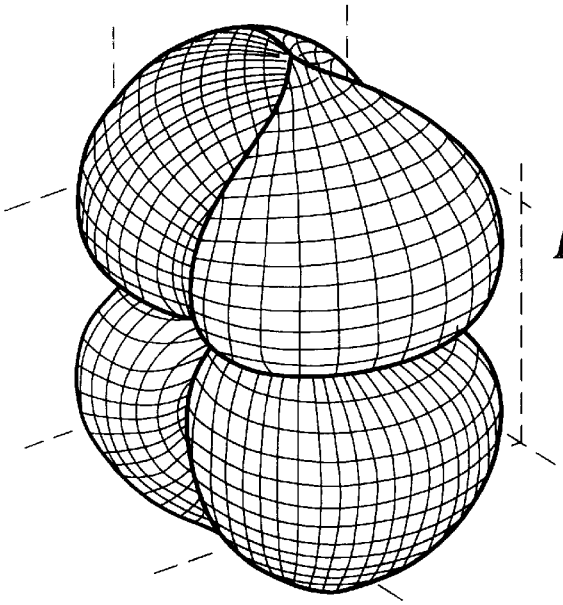
Figure 27B:
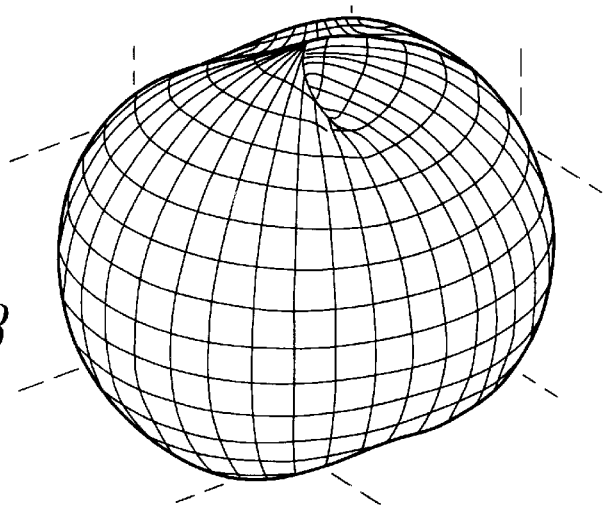
Figure 27C:
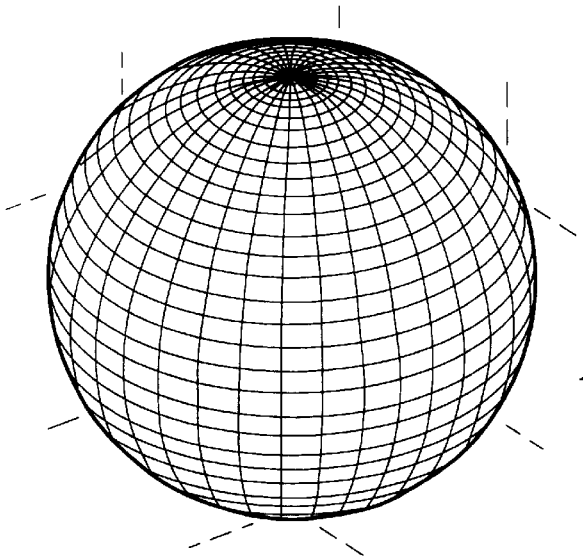
Figure 28A:
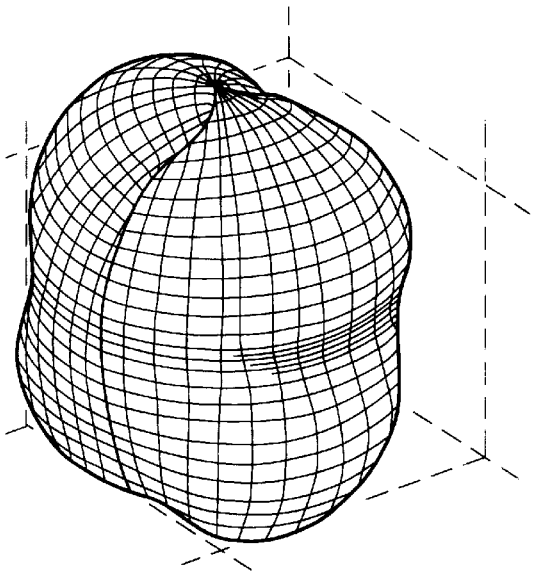
Figure 28B:
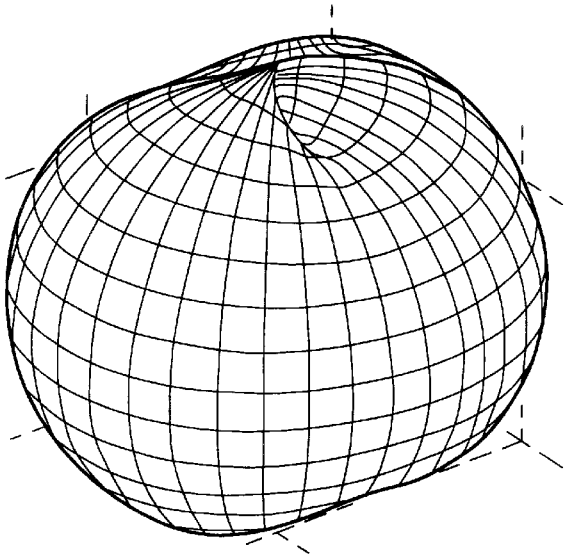
Figure 28C:
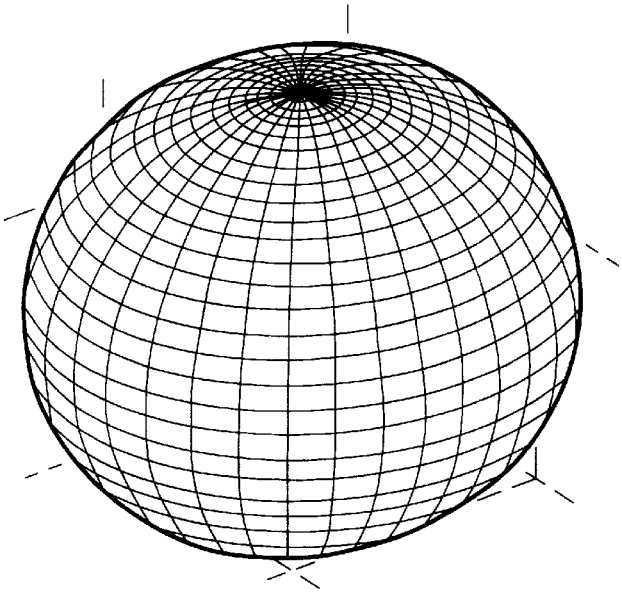

FIGS. 21A–21C through 28A–28C are far-field plots of theta-polarized gain (FIGS. 21A–28A), phi-polarized gain (FIGS. 21B–28B), and total gain (FIGS. 21C–28C) for the feeds of FIGS. 5A–5H, respectively, at the respective first resonances. These plots show the relative shapes and magnitudes of the radiation patterns for those feeds. The null 360 (FIG. 21B) and the null 362 (FIG. 23B) are relatively deep nulls in the phi-polarized gain pattern where very large drops in performance are observed, such as, for example, above and below in the case of a vertical dipole (not shown). These nulls are in contrast to simple dimples or flat spots (see FIG. 26B) typically observed with the feed of FIG. 5F. The nulls, for example, may be employed to reject noise from unwanted sources. Benefits in the input impedance spectrum as derived, for example, from non-symmetric feeds, such as the feed 80 of FIG. 5B, yield non-symmetry in the corresponding radiation pattern as shown in FIGS. 22A–22C.

Figure 29:
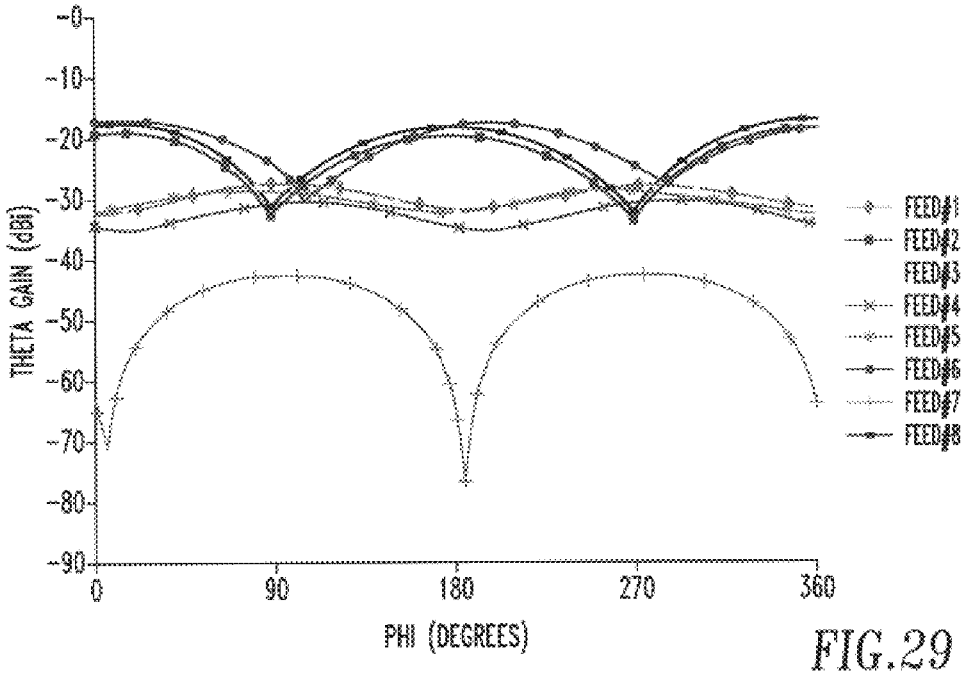
FIG. 29 is an azimuth cut of theta-polarized gain versus phi-degrees at each of the first resonances for the feeds of FIGS. 5A–5H.
Figure 30:
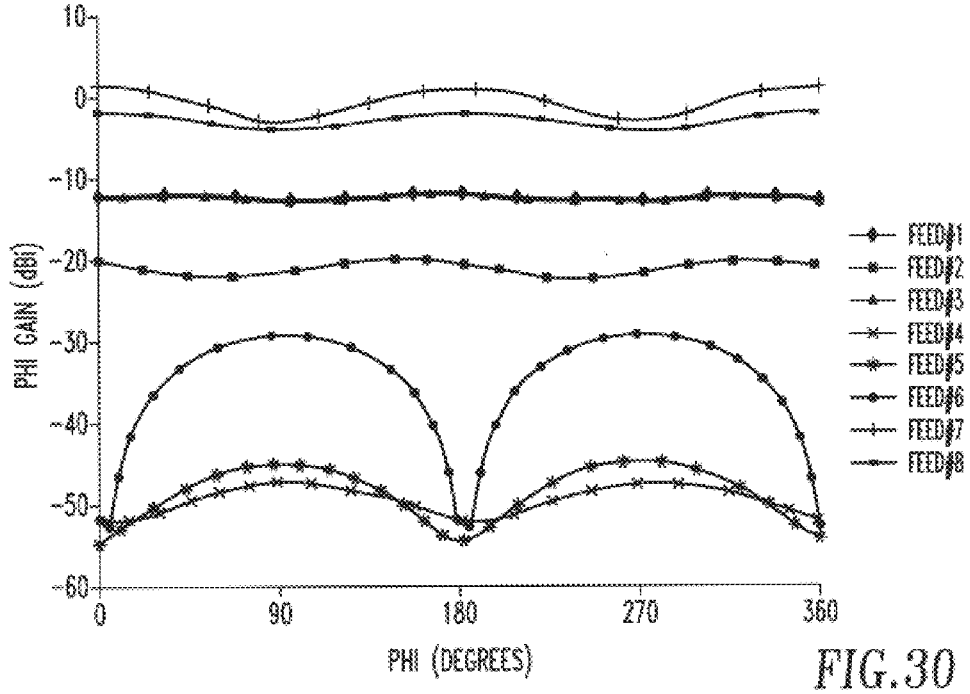
FIG. 30 is an azimuth cut of phi-polarized gain versus phi-degrees at each of the first resonances for the feeds of FIGS. 5A–5H.
Figure 31:
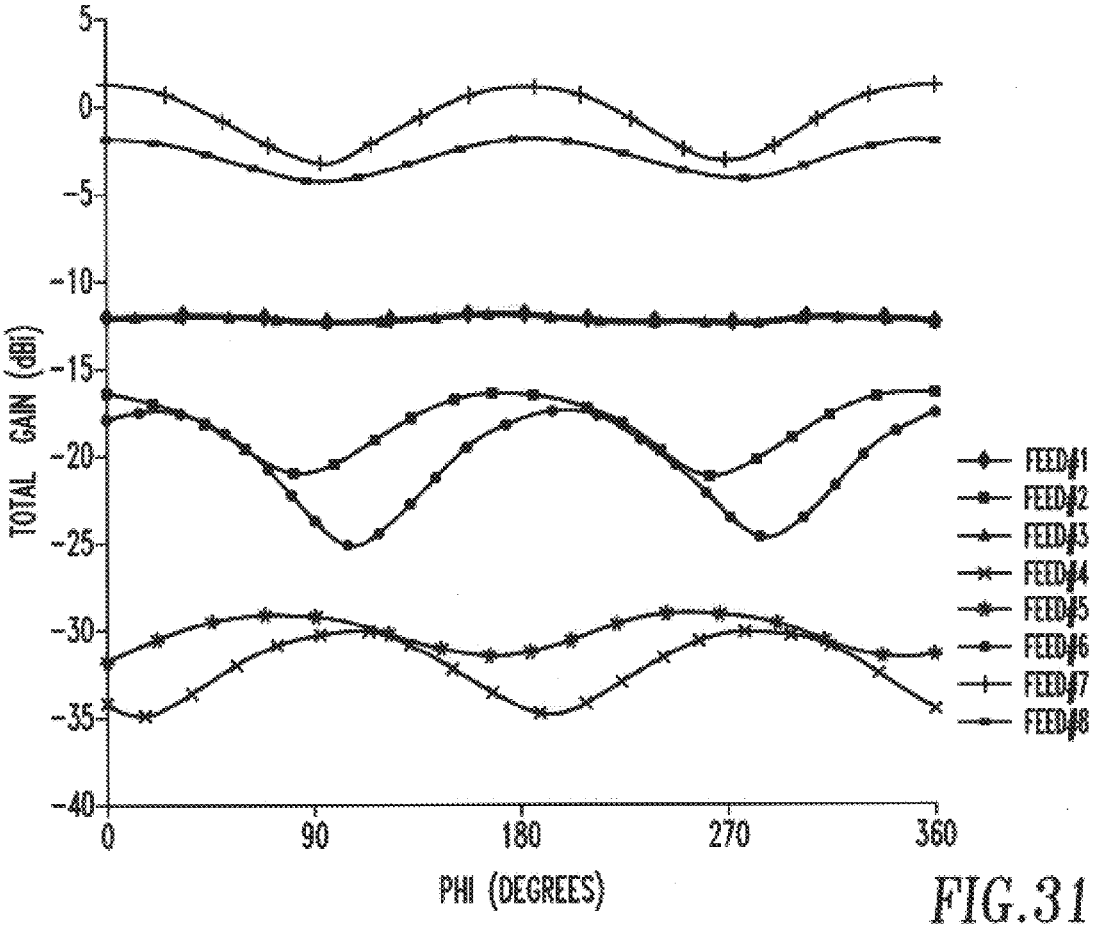
FIG. 31 is an azimuth cut of total gain versus phi-degrees at each of the first resonances for the feeds of FIGS. 5A–5H.

FIGS. 29–31 show various slices of the 3D radiation patterns of FIGS. 21A–28C, in order to better illustrate relative quantities. These comparisons are at the respective first resonances and, therefore, are not at the same frequency. FIG. 29 shows an azimuth cut of theta-polarized gain versus phi-degrees at each of the first resonances for the respective feeds of FIGS. 5A–5H. FIGS. 30 and 31 similarly show an azimuth cut of phi-polarized gain versus phi-degrees, and an azimuth cut of total gain versus phi-degrees, respectively.

Figure 32:
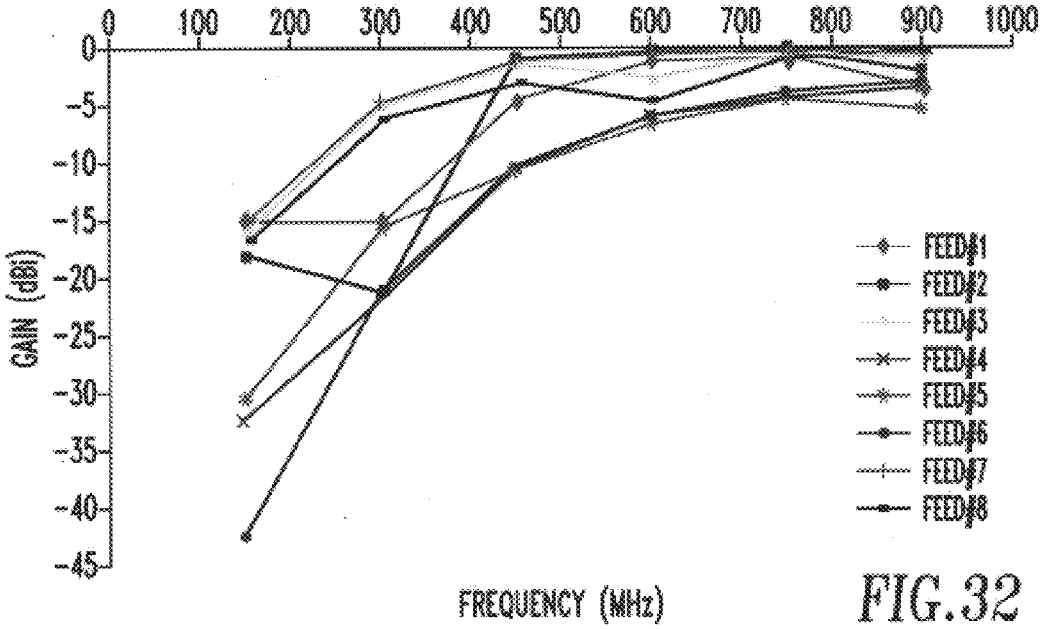
FIG. 32 is a plot of total gain versus frequency averaged over the entire far-field sphere in order to approximate efficiency.
Figure 33:
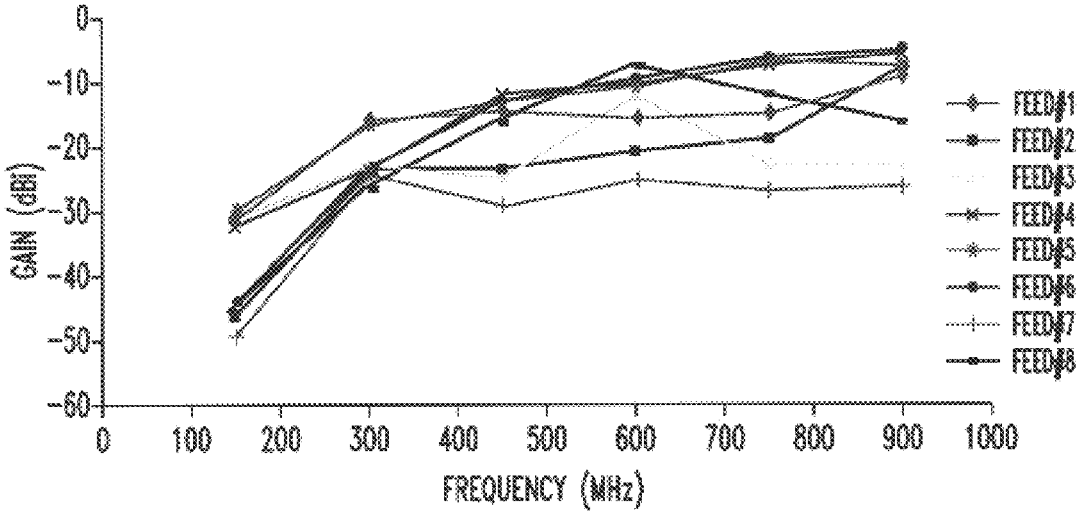
FIG. 33 is a plot of theta-polarized gain versus frequency averaged over the azimuth cut.
Figure 34:
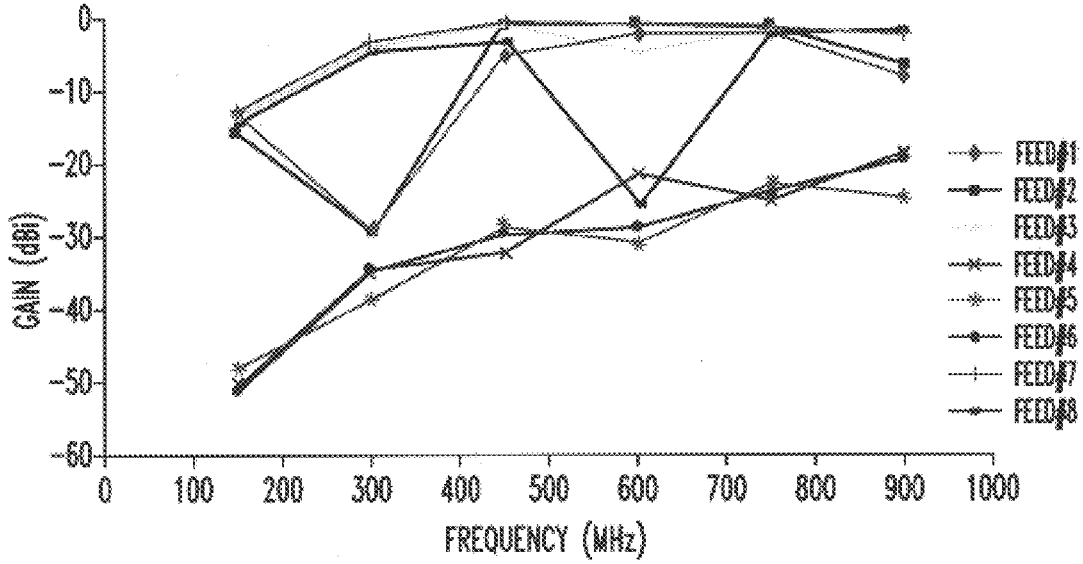
FIG. 34 is a plot of phi-polarized gain versus frequency averaged over the azimuth cut.

FIGS. 32–34 illustrate the relative performance of a CTHA antenna, which employs the different feeds of FIGS. 5A–5H, throughout the spectrum. FIG. 32 is a plot of total gain versus frequency averaged over the entire far-field sphere in order to approximate efficiency. FIGS. 33 and 34 are plots of theta-polarized gain and phi-polarized gain, respectively, versus frequency averaged over the azimuth cut. FIG. 32 shows that the feed of FIG. 5F is not the most efficient radiator; however, comparison between FIG. 32 and FIG. 34 shows that the most efficient feeds are those that excel in the production of phi-polarized energy in the azimuthal plane. It is believed that these relatively efficient antenna feeds will solve various communication needs. For example, feed 60 (FIG. 5G) has high efficiency, as shown in FIG. 32, but low theta-polarized energy in the azimuthal plane, as shown in FIG. 33, and high phi-polarized energy in the azimuthal plane, as shown in FIG. 34, which would make it preferred for television, as contrasted with FM radio.

An original goal of obtaining vertically polarized energy from a low profile antenna is best judged from FIG. 33 for the azimuthal plane. From 450 MHz and up (about 1.5 times the first resonance of the feed of FIG. 5F), the feed of FIG. 5F has a relatively high efficiency, as do feed 100 of FIG. 5D and the feed of FIG. 5E. While not more efficient, it is believed that these latter two feeds may be more readily matched at 450 MHz, due to proximity of the resonances.

Furthermore, the feed 40 of FIG. 5H appears to have one highly efficient point at its second resonance of 600 MHz. Also, below 450 MHz, feed 30 (FIG. 5A) and the feed of FIG. 5E are more efficient than the feed of FIG. 5F. Further, below 300 MHz, the feeds 90 (FIG. 5C) and 100 (FIG. 5D) are also more efficient than the feed of FIG. 5F at theta-polarized radiation in the azimuth plane. While that latter feed usually produces one of the more spherical theta-polarized patterns, the strong phi-polarized feeds 30,90,60, 40 (FIGS. 5A, 5C, 5G, 5H, respectively) are more spherical in the phi-polarized radiation. The diverse resonances have an effect on where various feeds are more spherical throughout the spectrum.

The exemplary relationships disclosed herein are for a single fixed-geometry antenna having different feeds. A different set of relationships may result from scaling the antennas with different feeds in order that they all have the same first resonance.

Operation of CTHA antennas, which employ the feeds disclosed herein, either on or off of resonance is a matter of providing a suitable matching mechanism in order that energy is successfully coupled into the antenna and standing waves are established to successfully radiate (or receive) the energy. Since this can be achieved ahnost anywhere in the impedance spectrum, the different feeds may be compared for efficiency without regard to their natural resonances.

As employed herein, the term sphericity quantifies the isotropic nature of the radiation pattern (i.e., smoothness over the sphere, not efficiency). The quantity developed here is roughly analogous to the standard deviation or variance of the gain over the entire sphere. As such, smaller numbers correspond to more spherical, or more isotropic, patterns.

Figure 35:
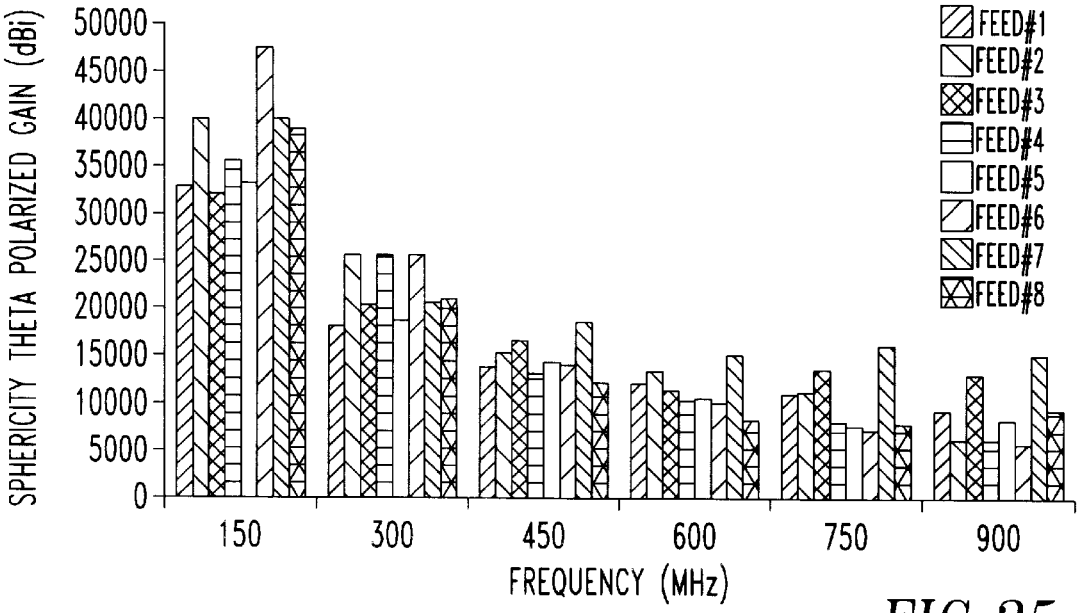
FIG. 35 is a plot of sphericity theta-polarized gain versus frequency for the feeds of FIGS. 5A–5H over the entire far-field sphere.
Figure 36:
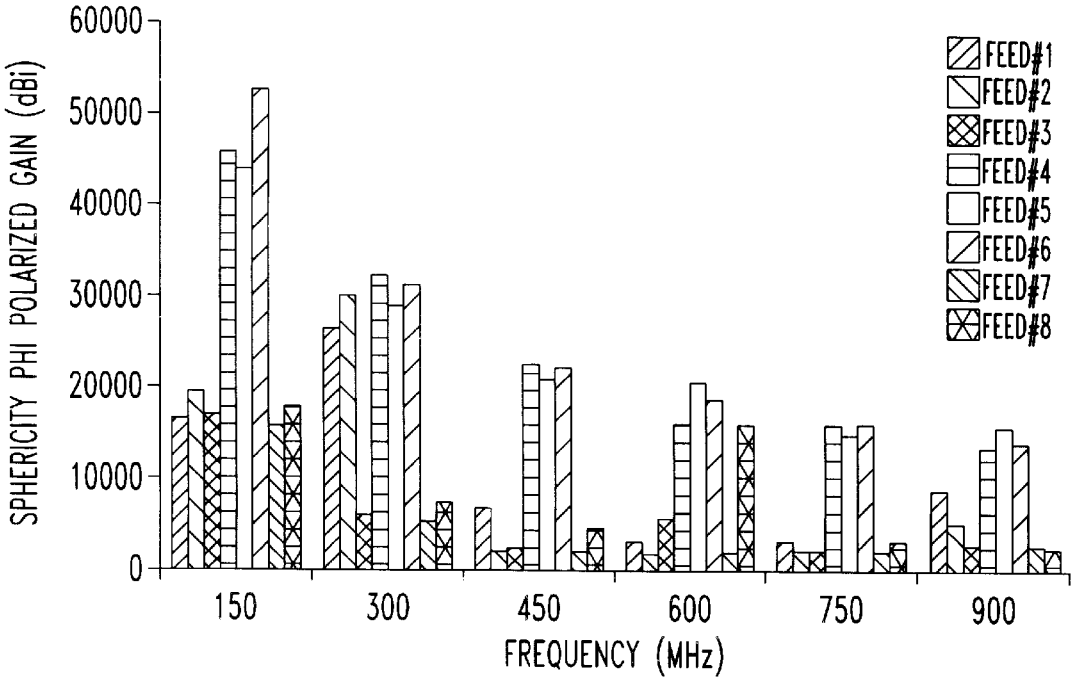
FIG. 36 is a plot of sphericity phi-polarized gain versus frequency for the feeds of FIGS. 5A–5H over the entire far-field sphere.
Figure 37:
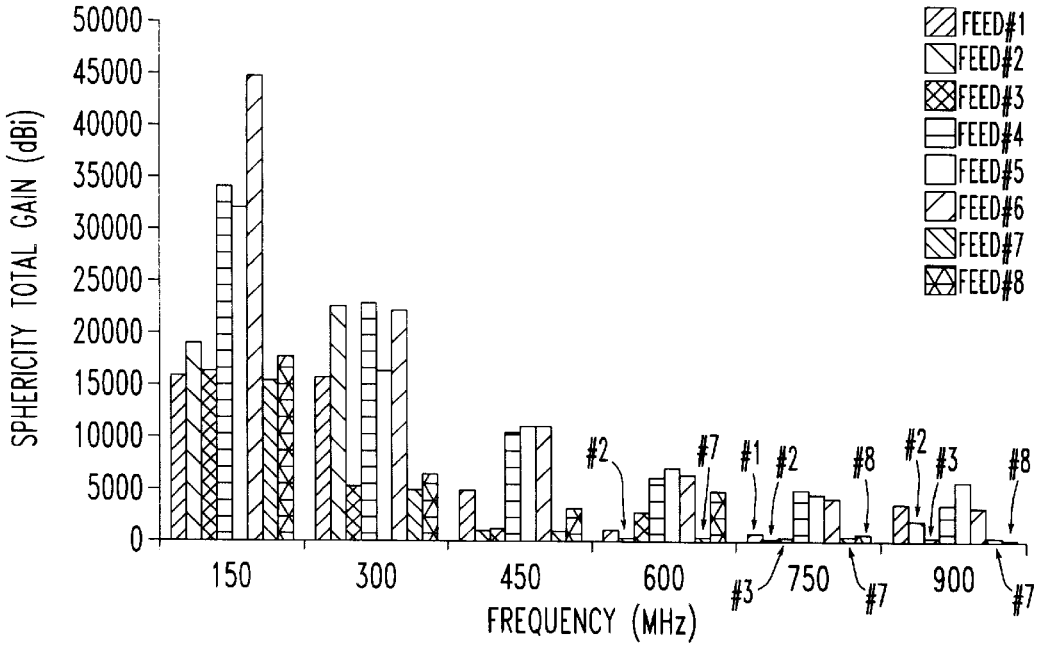
FIG. 37 is a plot of sphericity total gain versus frequency for the feeds of FIGS. 5A–5H over the entire far-field sphere.

FIG. 35 is a plot of sphericity theta-polarized gain versus frequency for the respective feeds of FIGS. 5A–5H over the entire far-field sphere. Similarly, FIGS. 36 and 37 are plots of sphericity phi-polarized gain and sphericity total gain, respectively, versus frequency for those feeds over the entire far-field sphere.

Figure 38A:
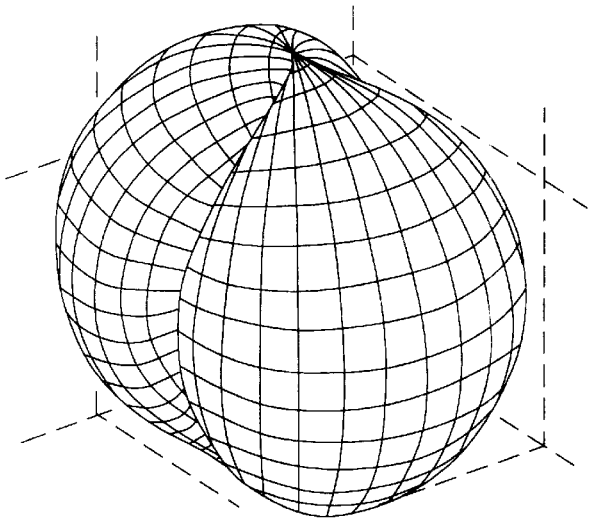
FIG. 38A PRIOR ART
FIGS. 38A–38C are far-field plots of theta-polarized gain, phi-polarized gain, and total gain, respectively, for a vertical loop.
Figure 38B:
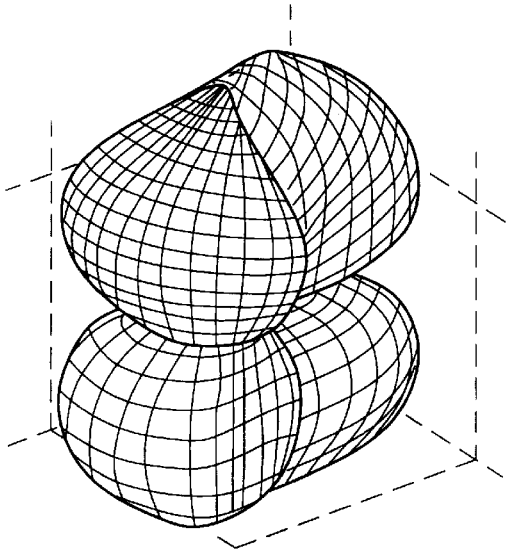
FIG. 38B PRIOR ART
Figure 38C:
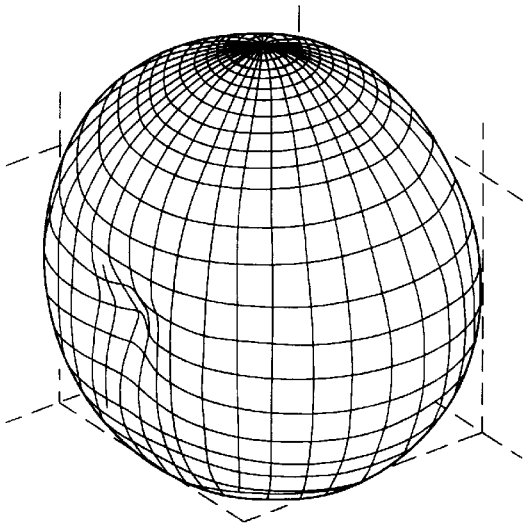
FIG. 38C PRIOR ART
Figure 39A:
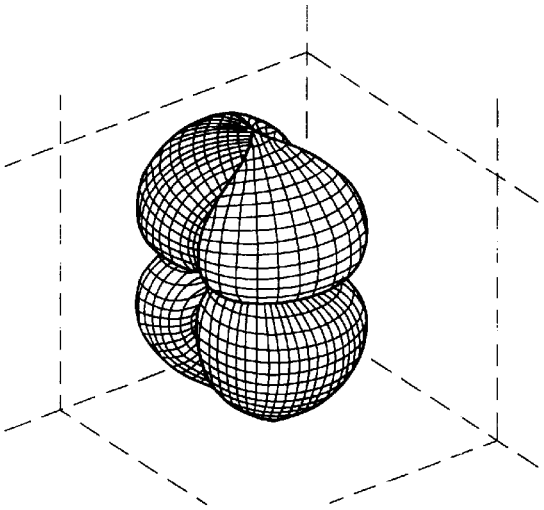
FIG.39A PRIOR ART
FIGS. 39A–39C are far-field plots of theta-polarized gain, phi-polarized gain, and total gain, respectively, for a horizontal loop.
Figure 39B:
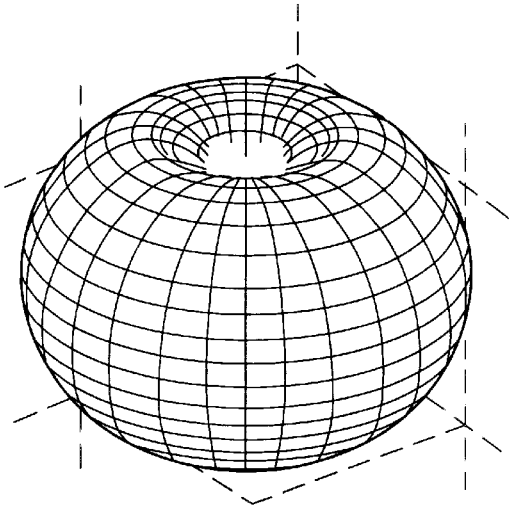
FIG.39B PRIOR ART
Figure 39C:
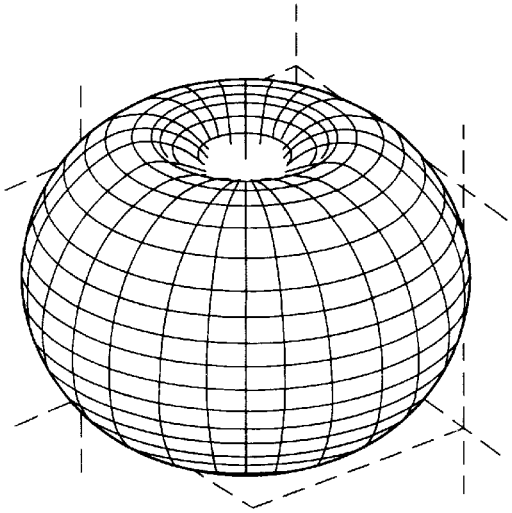
FIG.39C PRIOR ART

FIGS. 38A–38C show far-field patterns for a conventional vertical loop produced for a full $\lambda$ resonance. The field patterns are similar to those of a CTHA employing the feed of FIG. 5F (see FIGS. 26A–26C) at second resonance (i.e., the full $\lambda$ resonance). FIGS. 39A–39C show far-field patterns for a conventional horizontal loop. FIGS. 38A and 39A show theta-polarized gain, FIGS. 38B and 39B show phi-polarized gain, and FIGS. 38C and 39C show total gain. These patterns illustrate similarities between full size vertical and horizontal loops and compact CTHAs.

Figure 40A:
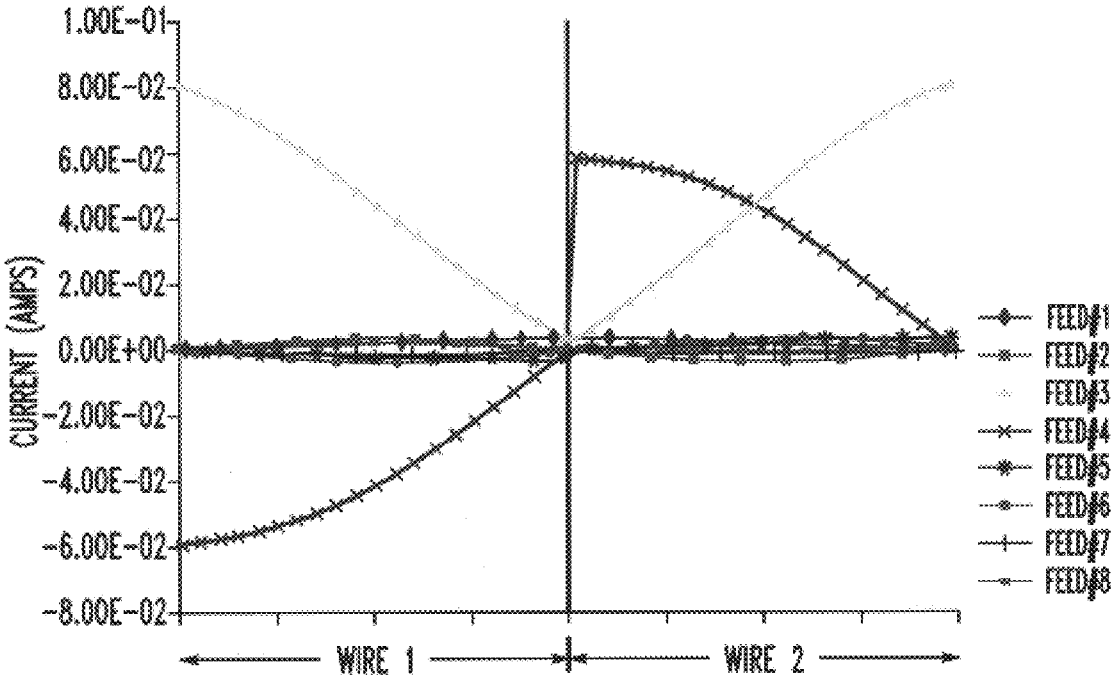
FIGS. 40A–40B are plots of current versus distance along the conductors in the two contrawound windings for the feeds of FIGS. 5A–5H.
Figure 40B:
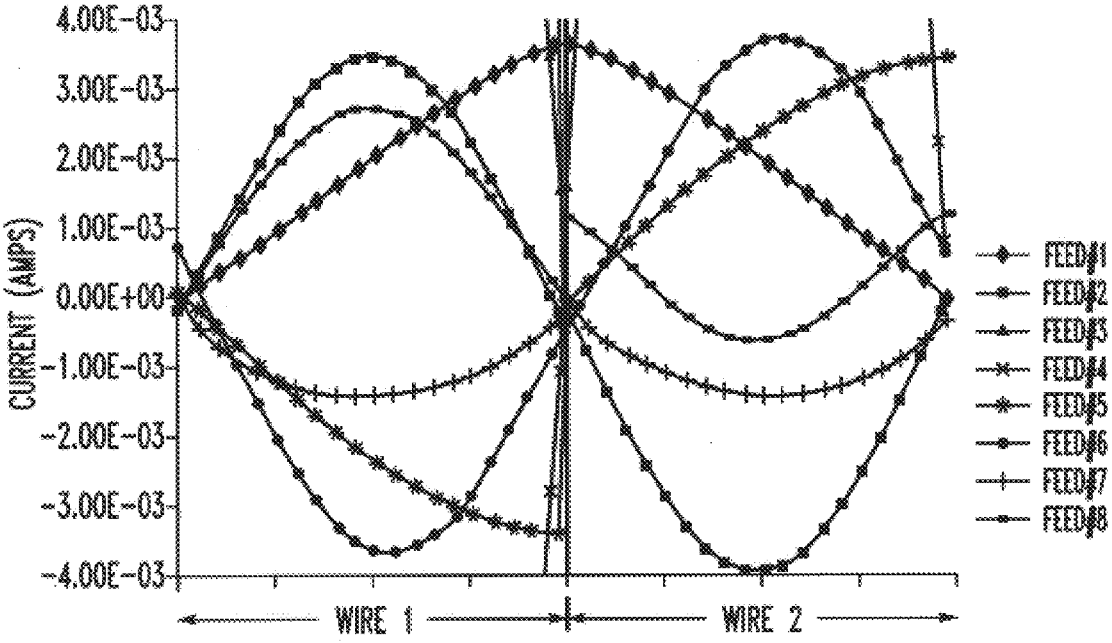

FIGS. 40A–40B show simulated currents versus length along the conductors in the two helical contrawound windings for the feeds of FIGS. 5A–5H. These show that the feeds of FIGS. 5E and 5F produce contra-currents, while the feed 60 of FIG. 5G produces similar currents, or co-currents. The relative magnitudes of the currents of the respective feeds vary as well. The second loop of feed 40 of FIG. 5H resonates naturally with a contra-current, but is not centered on the vertical current axis. Since the second loop of feed 40 is not electrically connected to that feed, it is free to float at some DC value above the driven helix center.

FIG. 41 shows an electromagnetic antenna 370, which employs ground plane 147, in order to form a monopole antenna. In this example, the signal terminal 246 of the feed 240 is electrically connected to the ground plane 147.

FIG. 42 shows an electromagnetic antenna 380, which employs reflector 148. In this example, the signal terminal 246 of the feed 240 is electrically connected to the reflector 246.

FIG. 43 shows an electromagnetic antenna 390, which employs a second CTHA antenna 149. In this example, the signal terminal 246 of the feed 240 is electrically connected to the second antenna 149.

Although reference is made in FIGS. 41–43 to the exemplary feed 240 of FIG. 6K, these examples are applicable to any of the exemplary feeds of FIGS. 6A–6M.

FIG. 44 shows an electromagnetic antenna 400 in which the antenna signal 402 is capacitively coupled to contrawound insulated conductors 404,406. A suitable circuit 408 is employed to capacitively couple the antenna signal 402.

FIG. 45 shows an electromagnetic antenna 410 in which signal terminals 412,414 provide antenna coupling of a passive CTHA element 416 in an array with an active dipole 418.

Figure 46:
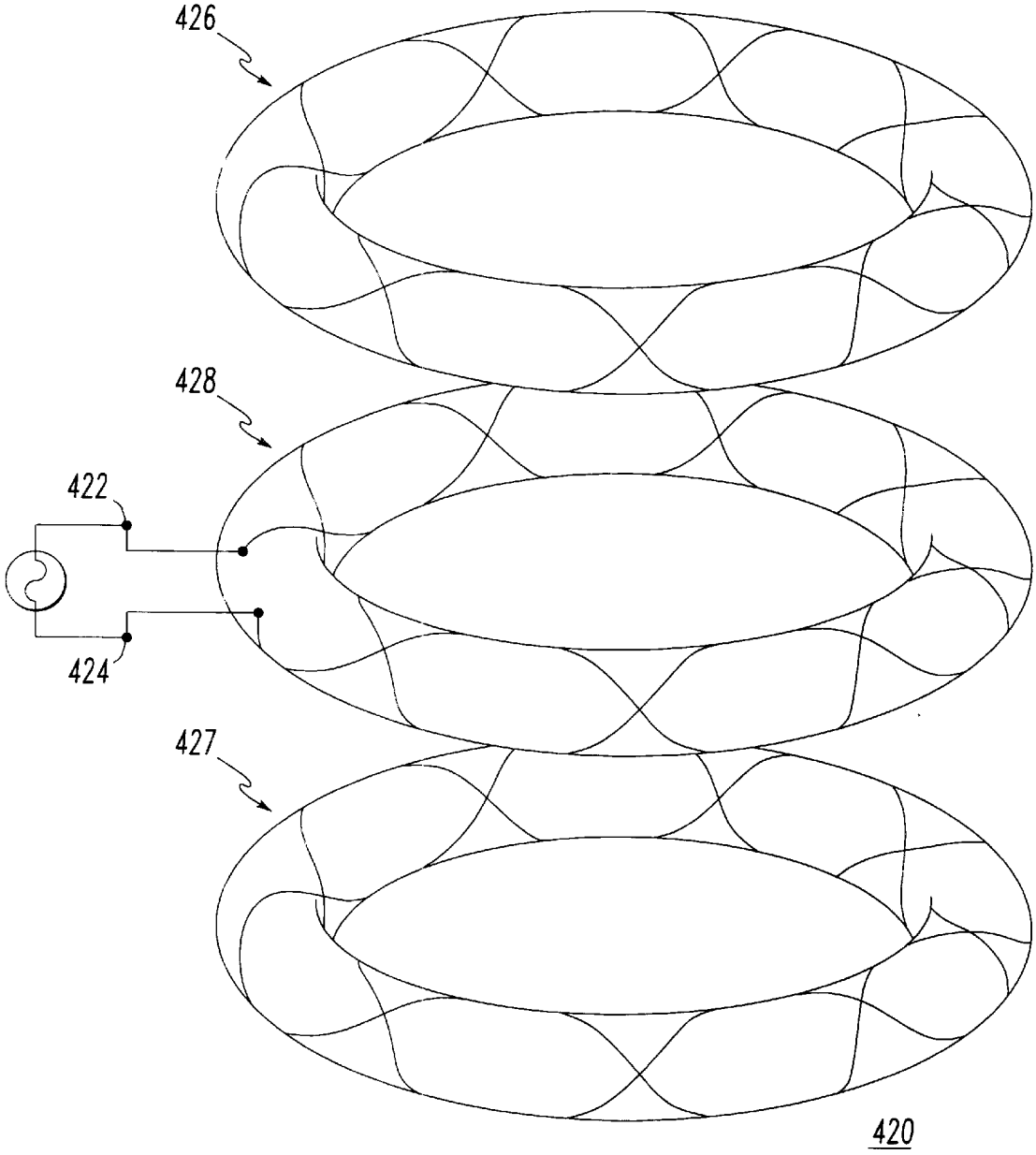
FIG. 46 is a block diagram in schematic form of an electromagnetic antenna in which signal terminals provide antenna coupling of passive elements in an array.

FIG. 46 shows an electromagnetic antenna 420 in which signal terminals 422,424 provide antenna coupling of passive CTHA elements 426,427 in an array with an active CTHA 428.

FIG. 47 shows an example of a conventional shielded loop 430 which is employed to magnetically couple an RF signal at signal carrying terminals 431,432 to or from a CTHA antenna 433. The shielded loop 430 is formed by a coaxial cable 434 (e.g., 50Ω), in which the shield 435 is cut at 436 and 438 to expose the center conductor 440. In turn, the center conductor 440 and the corresponding shield 435 are electrically connected to the exposed shield 435 at 441. The exposed center conductor 440 (or cut shield) at 436 serves to stop the current flow in the shield 435. Although no electrical connection is made from the coupling loop 442 to the antenna 433, the loop 442 is suitably positioned in proximity to the CTHA 433, and preferably without passing completely around the exemplary toroidal surface, in order to couple and match RF energy to or from the antenna 433. Preferably, the size of the loop 442 is relatively small with respect to the wavelength, λ, of the RF signal at terminals 431,432.

FIGS. 48 and 49 show other variations of multiply connected surfaces 450 and 452, respectively. The surface 450 has a cross-section 454, which is a generally connected form. The surface 452 is a generalized toroid having a cross-section 456, which is non-circular (e.g., oval, elliptical, egg-shaped).

As disclosed in U.S. Pat. No. 6,028,558, the exemplary contrawound conductors or conductive paths, such as the exemplary insulated conductors 18,20 of FIG. 4A, may be contrawound helical conductive paths having the same number of turns, with the helical pitch sense for one conductive path being right hand (RH), and the helical pitch sense for the other conductive path being left hand (LH), which is opposite from the RH pitch sense. The exemplary conductive paths disclosed herein may be arranged in other than a helical fashion, such as a generally helical fashion, a spiral fashion, a caduceus fashion, or any contrawound fashion, and still satisfy the spirit of this invention. The conductive paths may further be contrawound "poloidal-peripheral winding patterns" having opposite winding senses (e.g., the helix formed by each of two insulated conductors is decomposed into a series of interconnected poloidal loops) (see, for example, U.S. Pat. No. 5,442,369). Although exemplary insulated conductor windings 18,20 are disclosed herein, such conductors need not be entirely insulated. In other words, such conductors, while being isolated from each other (except at points where electrical connections are intended), may employ other forms of insulation (e.g., without limitation, air gaps).

As disclosed herein, different modes of operation of the CTHA may be induced by different feed configurations.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface; and first and second signal terminals, wherein said first node is electrically connected to said fourth node, and said first and second signal terminals are electrically connected to said second and third nodes, respectively.

2. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface; and first and second signal terminals, wherein said third node is electrically connected to said fourth node, and said first and second signal terminals are electrically connected to said first and second nodes, respectively.

3. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface; and first and second signal terminals, wherein said second node is electrically connected to said third node and said fourth node, and said first and second signal terminals are electrically connected to: (a) said second, third and fourth nodes, and (b) said first node, respectively.

4. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface; and first and second signal terminals, wherein said first node is electrically connected to said second node, said third node is electrically connected to said fourth node, and said first and second signal terminals are electrically connected to: (a) said first and second nodes, and (b) said third and fourth nodes, respectively.

5. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface; and first and second signal terminals, wherein at least one of said nodes is open.

6. The electromagnetic antenna of claim 5, wherein said first and second signal terminals are electrically connected to said first and second nodes, respectively; and said third and fourth nodes are open.

7. The electromagnetic antenna of claim 5, wherein said first and second signal terminals are electrically connected to said second and third nodes, respectively; and said first and fourth nodes are open.

8. The electromagnetic antenna of claim 5, wherein said first and second signal terminals are electrically connected to said first and third nodes, respectively; and said second and fourth nodes are open.

9. The electromagnetic antenna of claim 5, wherein said first node is electrically connected to said third node;

said fourth node is open; and said first and second signal terminals are electrically connected to: (a) said first and third nodes, and (b) said second node, respectively.

10. The electromagnetic antenna of claim 5, wherein said second node is electrically connected to said third node;

said fourth node is open; and said first and second signal terminals are electrically connected to: (a) said second and third nodes, and (b) said first node, respectively.

11. The electromagnetic antenna of claim 5, wherein said first node is electrically connected to said second node;

said fourth node is open; and said first and second signal terminals are electrically connected to: (a) said first and second nodes, and (b) said third node, respectively.

12. The electromagnetic antenna of claim 5, wherein said second, third and fourth nodes are open;

said first signal terminal is electrically connected to said first node; and said second signal terminal is structured for connection to a cooperative antenna structure.

13. The electromagnetic antenna of claim 5, wherein said first node is electrically connected to said third node;

said second and fourth nodes are open;

said first signal terminal is electrically connected to said first and third nodes; and said second signal terminal is structured for connection to a cooperative antenna structure.

14. The electromagnetic antenna of claim 5, wherein said first node is electrically connected to said fourth node;

said second and third nodes are open;

said first signal terminal is electrically connected to said first and fourth nodes; and said second signal terminal is structured for connection to a cooperative antenna structure.

15. The electromagnetic antenna of claim 5, wherein said third node is electrically connected to said fourth node;

said first and second nodes are open;

said first signal terminal is electrically connected to said third and fourth nodes; and said second signal terminal is structured for connection to a cooperative antenna structure.

16. The electromagnetic antenna of claim 5, wherein said first node is electrically connected to said third and fourth nodes;

said second node is open;

said first signal terminal is electrically connected to said first, third and fourth nodes; and said second signal terminal is structured for connection to a cooperative antenna structure.

17. The electromagnetic antenna of claim 5, wherein said first node is electrically connected to said third node;

said second node is open;

said first signal terminal is electrically connected to said fourth node; and said second signal terminal is structured for connection to a cooperative antenna structure.

18. The electromagnetic antenna of claim 5, wherein said first node is electrically connected to said fourth node;

said second node is open;

said first signal terminal is electrically connected to said third node; and said second signal terminal is structured for connection to a cooperative antenna structure.

19. The electromagnetic antenna of claim 5, wherein said third node is electrically connected to said fourth node;

said second node is open;

said first signal terminal is electrically connected to said first node; and said second signal terminal is structured for connection to a cooperative antenna structure.

20. The electromagnetic antenna of claim 5 wherein said multiply connected surface is a toroidal surface.

21. The electromagnetic antenna of claim 5 wherein a plurality of said nodes are open.

22. The electromagnetic antenna of claim 5, wherein said multiply connected surface has a cross section which is a generally connected form.

23. The electromagnetic antenna of claim 5, wherein said first and second pitch or winding senses are first and second helical pitch senses.

24. The electromagnetic antenna of claim 5, wherein said first and second pitch or winding senses are first and second poloidal-peripheral winding patterns.

25. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface; and first and second signal terminals, wherein said first, third and fourth nodes are electrically connected, wherein one of said first and second signal terminals is electrically connected to said second node, and wherein the other of said first and second signal terminals is structured for connection to a cooperative antenna structure.

26. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface;

first and second signal terminals; and a cooperative antenna structure, wherein one of said first and second signal terminals is electrically connected to at least one of said nodes, and wherein the other of said first and second signal terminals is electrically connected to said cooperative antenna structure.

27. The electromagnetic antenna of claim 26, wherein said second, third and fourth nodes are open;

said first signal terminal is electrically connected to said first node; and said second signal terminal is electrically connected to said cooperative antenna structure.

28. The electromagnetic antenna of claim 26, wherein said first node is electrically connected to said third node;

said second and fourth nodes are open;

said first signal terminal is electrically connected to said first and third nodes; and said second signal terminal is electrically connected to said cooperative antenna structure.

29. The electromagnetic antenna of claim 26, wherein said first node is electrically connected to said fourth node;

said second and third nodes are open;

said first signal terminal is electrically connected to said first and fourth nodes; and said second signal terminal is electrically connected to said cooperative antenna structure.

30. The electromagnetic antenna of claim 26, wherein said third node is electrically connected to said fourth node;

said first and second nodes are open;

said first signal terminal is electrically connected to said third and fourth nodes; and said second signal terminal is electrically connected to said cooperative antenna structure.

31. The electromagnetic antenna of claim 26, wherein said first node is electrically connected to said third and fourth nodes;

said second node is open;

said first signal terminal is electrically connected to said first, third and fourth nodes; and said second signal terminal is electrically connected to said cooperative antenna structure.

32. The electromagnetic antenna of claim 26, wherein said first node is electrically connected to said third node;

said second node is open;

said first signal terminal is electrically connected to said fourth node; and said second signal terminal is electrically connected to said cooperative antenna structure.

33. The electromagnetic antenna of claim 26, wherein said first node is electrically connected to said fourth node;

said second node is open;

said first signal terminal is electrically connected to said third node; and said second signal terminal is electrically connected to said cooperative antenna structure.

34. The electromagnetic antenna of claim 26, wherein said third node is electrically connected to said fourth node;

said second node is open;

said first signal terminal is electrically connected to said first node; and said second signal terminal is electrically connected to said cooperative antenna structure.

35. The electromagnetic antenna of claim 26, wherein said first node is electrically connected to said second node;

said third node is electrically connected to said fourth node;

said first signal terminal is electrically connected to said first, second, third, and fourth nodes; and said second signal terminal is electrically connected to said cooperative antenna structure.

36. The electromagnetic antenna of claim 26, wherein said first node is electrically connected to said third node;

said second node is electrically connected to said fourth node;

said first signal terminal is electrically connected to said second and fourth nodes; and said second signal terminal is electrically connected to said cooperative antenna structure.

37. The electromagnetic antenna of claim 26, wherein said first node is electrically connected to said fourth node;

said second node is electrically connected to said third node;

said first signal terminal is electrically connected to said second and third nodes; and said second signal terminal is electrically connected to said cooperative antenna structure.

38. The electromagnetic antenna of claim 26, wherein said first node is electrically connected to said second node;

said third node is electrically connected to said fourth node;

said first signal terminal is electrically connected to said first and second nodes; and said second signal terminal is electrically connected to said cooperative antenna structure.

39. The electromagnetic antenna of claim 26, wherein said first node is electrically connected to said third node and said fourth node;

said first signal terminal is electrically connected to said second node; and said second signal terminal is electrically connected to said cooperative antenna structure.

40. The electromagnetic antenna of claim 26, wherein said cooperative antenna structure is a ground plane.

41. The electromagnetic antenna of claim 26, wherein said cooperative antenna structure is a reflector.

42. The electromagnetic antenna of claim 26, wherein said cooperative antenna structure is a contrawound toroidal helical antenna.

43. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface;

first and second signal terminals structured for transmitting or receiving an antenna signal; and means for coupling said antenna signal to or from said first and second insulated conductors, wherein at least one of said nodes is open.

44. The electromagnetic antenna of claim 43, wherein said first, second, third and fourth nodes are open.

45. The electromagnetic antenna of claim 43, wherein said first node is electrically connected to said third node; and said second and fourth nodes are open.

46. The electromagnetic antenna of claim 43, wherein said first node is electrically connected to said fourth node; and said second and third nodes are open.

47. The electromagnetic antenna of claim 43, wherein said third node is electrically connected to said fourth node; and said first and second nodes are open.

48. The electromagnetic antenna of claim 43, wherein said first node is electrically connected to said third node and said fourth node; and said second node is open.

49. The electromagnetic antenna of claim 43, wherein said means for coupling said antenna signal includes an inductively or magnetically coupled loop.

50. The electromagnetic antenna of claim 43, wherein said means for coupling said antenna signal includes means for capacitively coupling said antenna signal.

51. The electromagnetic antenna of claim 43, wherein said first and second signal terminals provide antenna coupling of at least one passive element in an array.

52. The electromagnetic antenna of claim 43, wherein said first and second signal terminals are electrically connected to a linear array; and at least some of said nodes are coupled to said linear array, in order to form an antenna array.

53. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface;

first and second signal terminals structured for transmitting or receiving an antenna signal; and means for coupling said antenna signal to or from said first and second insulated conductors, wherein said first node is electrically connected to said second node, said third node is electrically connected to said fourth node, and said first and second nodes are electrically connected to said third and fourth nodes.

54. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface;

first and second signal terminals structured for transmitting or receiving an antenna signal; and means for coupling said antenna signal to or from said first and second insulated conductors, wherein said first node is electrically connected to said third node, and said second node is electrically connected to said fourth node.

55. The electromagnetic antenna of claim 54 wherein said insulated conductors include a single insulated conductor which forms a single endless conductive path.

56. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface;

first and second signal terminals structured for transmitting or receiving an antenna signal; and a shielded loop, proximate said multiply connected surface, without passing completely around said surface, said shielded loop electrically connected to said signal terminals and coupling said antenna signal to or from said first and second insulated conductors, wherein said first node is electrically connected to said fourth node, and said second node is electrically connected to said third node.

57. The electromagnetic antenna of claim 56 wherein said insulated conductors include a single insulated conductor which forms a single endless conductive path.

58. An electromagnetic antenna comprising:

a multiply connected surface;

first and second insulated conductors, said first insulated conductor extending around and over said multiply connected surface with a first pitch or winding sense from a first node to a second node, said second insulated conductor also extending around and over said multiply connected surface with a second pitch or winding sense, which is opposite from the first pitch or winding sense, from a third node to a fourth node, in order that said first and second insulated conductors are contrawound relative to each other around and over said multiply connected surface;

first and second signal terminals structured for transmitting or receiving an antenna signal; and means for coupling said antenna signal to or from said first and second insulated conductors, wherein said first node is electrically connected to said second node, and said third node is electrically connected to said fourth node.

59. The electromagnetic antenna of claim 58 wherein said insulated conductors have polar crossings on said surface.

60. The electromagnetic antenna of claim 58 wherein said insulated conductors have equatorial crossings on said surface.

* * * * *

UNITED STATES PATENT AND TRADEMARK OFFICE

CERTIFICATE OF CORRECTION

PATENT NO. : 6,437,751 B1
DATED : August 20, 2002
INVENTOR(S) : Robert P. M. Craven et al.

It is certified that error appears in the above-identified patent and that said Letters Patent is hereby corrected as shown below:

Column 3,
Line 37, "second.signal" should read -- second signal --.

Column 5,
Line 47, insert -- The patent or application file contains at least one drawing executed in color. Copies of this patent or patent application publication with color drawing(s) will be provided by the Office upon request and payment of the necessary fee. --

Column 9,
Lines 29 through 34, where "⇆" appears, insert -- <–> --.

Column 17,
Line 63, "ahnost" should read -- almost --.

Signed and Sealed this

Nineteenth Day of August, 2003

JAMES E. ROGAN
*Director of the United States Patent and Trademark Office*